US005611224A

United States Patent [19]

Weinerman et al.

[11] Patent Number: 5,611,224

[45] Date of Patent: Mar. 18, 1997

[54] HANDLE OPERABLE ROTARY LATCH AND LOCK

[75] Inventors: Lee S. Weinerman, Medina; Scott A. Arthurs, Brunswick, both of Ohio

[73] Assignee: The Eastern Company, Cleveland, Ohio

[21] Appl. No.: 577,720

[22] Filed: Dec. 22, 1995

Related U.S. Application Data

[63] Continuation-in-part of Ser. No. 510,470, Aug. 2, 1995, Pat. No. 5,564,295, and a continuation of Ser. No. 145,691, Oct. 29, 1993, Pat. No. 5,439,260.

[51] Int. Cl.[6] ..... E05C 3/26

[52] U.S. Cl. ..... 70/208; 70/472; 292/240

[58] Field of Search ..... 70/208, 109, 467, 70/486, 472; 292/34, 36, 240, DIG. 31

[56] References Cited

U.S. PATENT DOCUMENTS

| | | | |
|---|---|---|---|
| 2,729,089 | 1/1956 | Pelcin | 70/151 |
| 3,333,878 | 8/1967 | Pelcin | 292/37 |
| 4,309,884 | 1/1982 | Davis | 70/472 |
| 4,312,203 | 1/1982 | Davis | 70/472 |
| 4,320,642 | 3/1982 | Pastva | 70/472 |

(List continued on next page.)

OTHER PUBLICATIONS

Versch Lock Mfg. Co., Inc., Columbia, SC, Two Untitled Product Information Sheets That Show RSL Series Paddle Locks, Date Unknown But Believed To Be Prior to Dec., 1995. See Also Two Pages of Versch Product Photos.

TRI/MARK Corporation, New Hampton, IA, Three Untitled Product Information Sheets (Believed To Be Pp. 8, 11 & 12 From A TRI/MARK Catalog) That Show Locks Of The 30–175, 30–400 and 30–450 Series, Date Unknown But Believed To Be Prior to Dec. 1995.

Cleveland Hardware, Cleveland, OH, One Untitled Product Information Sheet Showing A No. 1–2600–AH Lock, Date Unknown But Believed To Be Prior to Dec., 1995.

Eberhard Manufacturing Co. (Division of the Eastern Company), Cleveland, OH, Catalog 106 Entitled "Industrial and Vehicular Hardware", 1994, pp. 4–9, 26, 32–36, 64–65 and 71–75.

General Motors Corp., Detroit, MI, Photos Showing A Vehicle Handle Assembly Part No. 15686155 Which Has Been Available At Chevrolet Dealers Since At Least As Early As 1993.

*Primary Examiner*—Lloyd A. Gall
*Assistant Examiner*—Tuyet-Phllong Pham
*Attorney, Agent, or Firm*—David A. Burge

[57] ABSTRACT

A slam-capable rotary latch employs a single rotary jaw that is releasably retained in its latched position by a rotary pawl, with the latch having a pair of spaced housing side plates that sandwich the rotary jaw and the rotary pawl, with the side plates defining aligned first and second U-shaped notches that cooperate with a third U-shaped notch formed in the rotary jaw for concurrently receiving and latchingly retaining within the confines of the first, second and third U-shaped notches a suitably configured strike formation, with housing side plate portions that define a selected one of the first and second U-shaped notches being rigidified and strengthened by the close proximity presence of a flange 1) that is formed integrally with side plate portions that define the selected notch and 2) that extends transversely to bridge between the housing side plates at a location near the first and second U-shaped notches. The rotary latch is particularly well suited to be bracket-mounted together with an operating linkage to form a modular assembly that can be installed behind the front wall of the closure of an industrial cabinet by utilizing the same threaded fasteners that are used to hold a flush-mountable paddle handle and housing assembly in place in a mounting opening that is formed through the front wall of the closure. The latch may be "locked" by positioning a movable locking member to extend into a path of movement of the operating linkage to selectively permit and prevent movement of the linkage along the path of movement.

40 Claims, 9 Drawing Sheets

U.S. PATENT DOCUMENTS

| | | | |
|---|---|---|---|
| 4,438,964 | 3/1984 | Peters | 292/216 |
| 4,641,865 | 2/1987 | Pastva | 292/5 |
| 4,706,478 | 11/1987 | Swan et al. | 70/208 |
| 4,892,338 | 1/1990 | Weinerman et al. | 292/35 |
| 4,896,906 | 1/1990 | Weinerman et al. | 292/48 |
| 4,911,487 | 3/1990 | Rachocki | 292/216 |
| 4,917,412 | 4/1990 | Swan et al. | 292/48 |
| 4,969,916 | 11/1990 | Weinerman et al. | 70/208 |
| 5,042,853 | 8/1991 | Gleason et al. | 292/126 |
| 5,058,937 | 10/1991 | Miehe et al. | 292/34 |
| 5,069,491 | 12/1991 | Weinerman et al. | 292/48 |
| 5,117,665 | 6/1992 | Swan et al. | 70/264 |
| 5,299,844 | 4/1994 | Gleason | 292/240 |
| 5,439,260 | 8/1995 | Weinerman et al. | 292/48 |

HANDLE OPERABLE ROTARY LATCH AND LOCK

CROSS-REFERENCE TO RELATED AND RELEVANT CASES

The present application is a continuation-in-part of application Ser. No. 08/510,470 filed Aug. 2, 1995, now U.S. Pat. No. 5,564,295 by Lee S. Weinerman et al entitled HANDLE OPERABLE ROTARY LATCH AND LOCK, which, in turn, was filed as a continuation of application Ser. No. 08/145,691 filed Oct. 29, 1993 by Lee S. Weinerman et al entitled HANDLE OPERABLE ROTARY LATCH AND LOCK which issued Aug. 8, 1995 as U.S. Pat. No. 5,439,260, which applications are referred to hereinafter as the "Parent Cases," the disclosures of which are incorporated herein by reference.

Reference also is made to a companion design case that is being filed concurrently herewith, namely application Ser. No. (Atty's file 5-217) filed (concurrently herewith) by Lee S. Weinerman et al entitled HANDLE AND HOUSING ASSEMBLY FOR LATCH OR LOCK; and to a companion utility application that also is being filed concurrently herewith, namely Ser. No. (Arty's file 5-218) filed (concurrently herewith) by Lee S. Weinerman et al entitled HANDLE OPERABLE TWO-POINT LATCH AND LOCK. These applications are referred to hereinafter as the "Companion Cases," the disclosures of which are incorporated herein by reference.

Reference also is made to a related utility application that is being filed concurrently herewith, namely HANDLE OPERABLE ROTARY LATCH AND LOCK, Ser. No. (Atty's file 5-260) filed (concurrently herewith) by Lee S. Weinerman et al, referred to hereinafter as the "Sister Case," the disclosure of which is incorporated herein by reference.

Each of the aforementioned Companion and Sister Cases is a continuation-in-part of application Ser. No. 08/510,470 filed Aug. 2, 1995 by Lee S. Weinerman et al entitled HANDLE OPERABLE ROTARY LATCH AND LOCK, which, in turn, was filed as a continuation of application Ser. No. 08/145,691 filed Oct. 29, 1993 by Lee S. Weinerman et al entitled HANDLE OPERABLE ROTARY LATCH AND LOCK which issued Aug. 8, 1995 as Pat. No. 5,439,260.

BACKGROUND OF THE INVENTION

1. Field of the Invention

The present invention relates to novel and improved slam-capable rotary latches and locks that typically are used in industrial cabinetry applications, and that are particularly well suited to be bracket-mounted together with an operating linkage to form a modular assembly that can be installed behind the front wall of the closure of an industrial cabinet by utilizing the same threaded fasteners that are used to hold a flush-mountable paddle handle and housing assembly in place in a mounting opening that is formed through the front wall of the closure. More particularly, the present invention relates to a rotary latch that employs a single rotary jaw that is releasably retained in its latched position by a rotary pawl, with the latch having a pair of spaced housing side plates that sandwich the rotary jaw and the rotary pawl, with the side plates defining aligned first and second U-shaped notches that cooperate with a third U-shaped notch formed in the rotary jaw to concurrently receive and latchingly retain within the confines of the first, second and third U-shaped notches a suitably configured strike formation, with housing side plate portions that define a selected one of the first and second U-shaped notches being rigidified and strengthened by the close proximity presence of a flange 1) that is formed integrally with side plate portions that define the selected notch and 2) that extends transversely to bridge between the housing side plates at a location near the first and second U-shaped notches.

2. Prior Art

Flush mountable, paddle-handle operated latches and locks are known that employ rotary latch bolts, also referred to as "rotary jaws," wherein the jaws are provided with U-shaped strike-receiving notches for latchingly receiving and releasably retaining suitably configured strike formations. Disclosures of latch and/or lock units of this type are found in U.S. Pat. No. 4,320,642 issued Mar. 23, 1982 to John V. Pastva, Jr., entitled PADDLE LOCKS WITH HANDLE DISCONNECT FEATURES; U.S. Pat. No. 4,917,412 issued Apr. 17, 1990 to Jye P. Swan et al, entitled VEHICLE DOOR LOCK SYSTEM PROVIDING A PLURALITY OF SPACED ROTARY LATCHES; U.S. Pat. No. 4,896,906 issued Jan. 30, 1990 to Lee S. Weinerman et al entitled VEHICLE DOOR LOCK; and, U.S. Pat. No. 5,069,491 issued Dec. 3, 1991 to Lee S. Weinerman et al entitled VEHICLE DOOR LOCK SYSTEM. The disclosures of these four U.S. patents are incorporated herein by reference.

The rotary latch and/or lock units that are disclosed in the four patents identified above are of a relatively heavy duty type that often are employed in "personnel restraint applications," typically on doors of passenger compartments of vehicles. These heavy duty units employ pairs of housing-mounted rotary jaws, with the jaws being sandwiched between pairs of housing side plates, and with notches that are formed in each pair of rotary jaws being configured to receive and engage opposite sides of a suitably configured strike formation, typically a cylindrical stem of a striker pin. While both of the housing side plates are provided with U-shaped notches, neither of these notches defines a strike engagement surface that cooperates with a notched rotary jaw to latchingly receive and releasably retain a strike formation. The notches that are formed in the jaws, not the notches that are formed in the housing side plates, receive, engage and latchingly retain suitably configured strike formations.

Lighter duty rotary latch and lock units that employ single rotary jaws also are known. For example, U.S. Pat. No. 4,312,203 issued Jan. 26, 1982 to Edwin W. Davis entitled FLUSH-MOUNTABLE LOCK WITH ACTUATOR DISCONNECT FEATURE discloses 1) the use of a single rotary latch jaw that is nested within and supported by portions of the housing of a flush mountable paddle-handle assembly, and 2) the use of a single U-shaped housing-carried notch that cooperates with the U-shaped notch formed in a rotary jaw to receive and latchingly retain a generally cylindrical strike formation. The disclosure of this patent is incorporated herein by reference.

3. The Referenced Parent Cases

Not addressed by the patents that are identified above is a long-standing need for a relatively light duty rotary latch that employs only a single rotary jaw instead of a pair of rotary jaws, that employs first and second housing side plates that define, respectively, first and second notches that are of generally U-shape, with the first and second U-shaped notches being positioned and aligned for cooperating with a third U-shaped notch that is formed in the single rotary jaw to receive and latchingly retain within the confines of the first, second and third notches a suitably configured strike formation, and with the latch making advantageous use of a transversely extending flange that is formed integrally with one of the first and second housing side plates to rigidify and strengthen housing side plate portions that define a strike-engaging surface of at least one of the aligned first and second U-shaped notches. Features of the inventions of the referenced Parent Cases address this need, and, in preferred practice, the present invention employs some of these features.

Also not addressed by the patents that are identified above is a long-standing need for a slam-capable, relatively light duty rotary latch and/or lock assembly that employs a single rotary jaw having a U-shaped notch formed therein that cooperates with a pair of housing side plates that define an aligned pair of U-shaped notches for cooperating with the notch formed in the rotary jaw to concurrently receive and latchingly retain within the confines of the three U-shaped notches a suitably configured strike formation, and that utilizes a stamped metal bracket 1) to assist in securely mounting the handle and housing assembly on a closure, 2) to assist in mounting the rotary lock assembly on a closure, and 3) to mount movable elements of an operating linkage that interconnects the handle and housing assembly with the rotary latch assembly for operating the latch (to release the rotary jaw from cooperating with the aligned U-shaped notches that are formed housing side plates) to "unlatch" the strike formation. Features of the inventions of the referenced Parent Cases address this need—as do features of the present invention.

4. The Referenced Companion and Sister Cases

The referenced Companion Design Case relates to a design for a Handle and Housing Assembly that is employed in carrying out the preferred practice of the present invention. The referenced Companion Utility Case relates to a Handle Operated Two-Point Latch and Lock that preferably utilizes the design of the Companion Design Case, and that preferably shares other features in common with the present invention and the inventions of the Parent Cases. The invention of the referenced Sister Case preferably makes use of selected features of the present invention and the inventions of the Parent Cases.

SUMMARY OF THE INVENTION

In preferred practice, the present invention provides an easy to install set of front and rear latch mechanism modules, and makes advantageous use of a rotary latch subassembly of a type that is disclosed in the referenced Parent Cases.

The Parent-Case type of rotary latch subassembly that is employed in the preferred practice of the present invention includes an elongate, generally rectangular first housing side plate having opposed end regions near opposite ends of the length thereof, and defining a first U-shaped notch located near one of the opposed end regions of the first housing side plate; an elongate, generally rectangular second housing side plate having opposed end regions near opposite ends of the length thereof, and defining a second U-shaped notch located near one of the opposed end regions of the second housing side plate, with the second U-shaped notch being configured to substantially align with the first U-shaped notch; spacer means for extending transversely between, for rigidly connecting with, and for holding in substantially parallel relationship the first and second housing side plates, with the spacer means including a first spacer that extends along a first transverse axis that intersects each of the first and second housing side plates at a location that is relative near to the other end regions thereof, and with the spacer means also including a second spacer that extends along a second transverse axis that intersects each of the first and second housing side plates at a location that is substantially mid-way between the opposite ends thereof; with the rotary latch bolt means including a rotary jaw and a rotary pawl that extend substantially within a common plane located between the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with an operating arm being provided for moving the rotary pawl to release the rotary jaw from its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation, and with a selected one of the first and second housing side plates being strengthened and enhanced in rigidity by the close proximity presence of a transversely extending flange that is formed integrally with the selected housing side plate.

Features of the preferred practice of the present invention reside 1) in providing a handle and housing assembly that defines a front module that is installed by inserting portions of its housing through the front side of a mounting opening that is formed in the front wall of a closure; 2) in providing a mounting bracket, a bracket-carried pivotally-mounted operating arm, and a bracket-carried rotary latch assembly that cooperate to define a rear module that is mountable behind the front wall of a closure; and 3) in configuring these front and rear modules such that they can be clamped securely in place when installed adjacent a mounting opening of a closure simply by tightening in place a set of threaded fasteners that extend through portions of one of the modules so as to be received in portions of the other of the modules, with this simple mounting technique serving to securely connect, align and ensure registry of the modules—to thereby ensure proper operation of the latch or lock.

In preferred practice, the bracket-carried, pivotally mounted operating arm of the rear module is supported on a bracket-carried post, with a torsion spring being wrapped about portions of the post and being connected to the operating arm for biasing the operating arm toward a position wherein the operating arm does not interfere with the rotary latch being "slam latched." The spring-biased operating arm is positioned and configured such that it can be pivoted about a pivot axis defined by the post to effect "unlatching" of the rotary latch only in response to movement of the front-module operating handle away from its normal, non-operated position toward its operated position.

By optionally providing a front-module-mounted key-operable lock mechanism for selectively positioning a locking member to extend into the path of movement of the back-module-mounted operating arm, the transfer of unlatching force through the operating arm to unlatch the rotary latch is controlled to selectively permit and prevent "unlatching" of the rotary latch from engagement with a suitably configured strike. In preferred practice, if an optional front-module-mounted lock mechanism is provided, the bracket of the rear module is provided with an opening through which rearwardly extending portions of the lock mechanism extend in a slip fit, by which arrangement the rear module bracket serves to strengthen and reinforce the mounting of the lock mechanism without having to be directly connected thereto by one or more fasteners.

While the inventions of the Parent Cases also provide latches and locks that employ front and rear modules, the preferred practice of the present invention provides a number of improvement features including a smaller set of component parts of improved design that function reliably during a service life of improved longevity while providing enhanced security together with ease of assembly, with a less complex linkage preferably being utilized to interconnect the operating handle of the front module with the rotary latch subassembly of the rear module.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

In the description that follows, the discussion that is associated with FIGS. 1–15 relates to the best mode known to the applicants for carrying out the preferred practice of the present invention—which employs what will be referred to as a "rotary latch subassembly" 400. The discussion that is associated with FIGS. 16 and 17 relates to an alternate embodiment that differs only in the nature of the gasketing that is provided, hence identical numerals are used in FIGS. 1–15 and in FIGS. 16–17 to refer to identical parts, and the only difference between the embodiments of FIGS. 1–15 has to do with the provision of gaskets that are utilized to seal around the closure openings in which the latch and lock unit embodiments are mounted.

Figure 16:
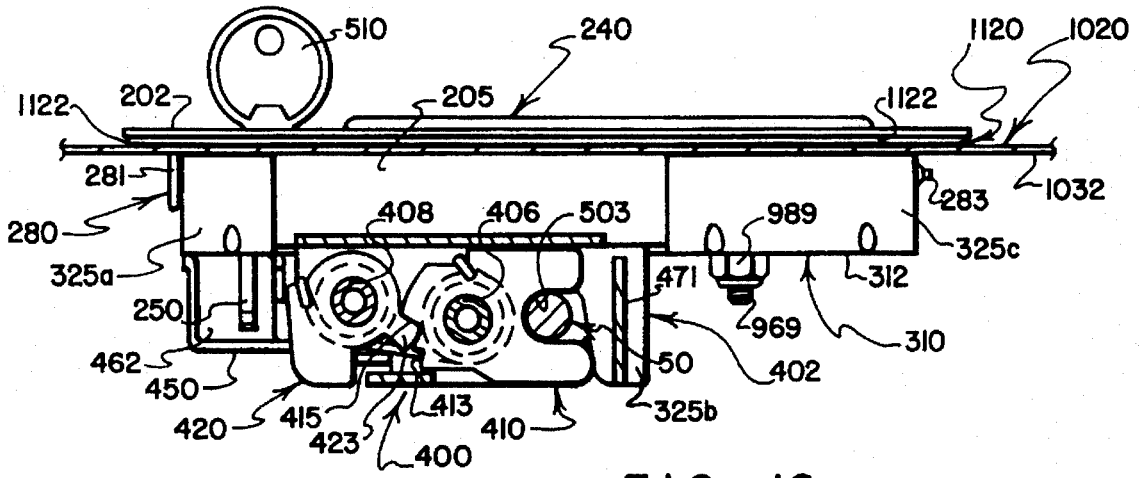
FIG. 16 is a sectional view similar to FIG. 4 but showing a differently gasketed embodiment of the rotary latch and lock unit; and, FIG. 17 is a sectional view similar to FIG. 5 also showing the embodiment of FIG. 16.
Figure 17:
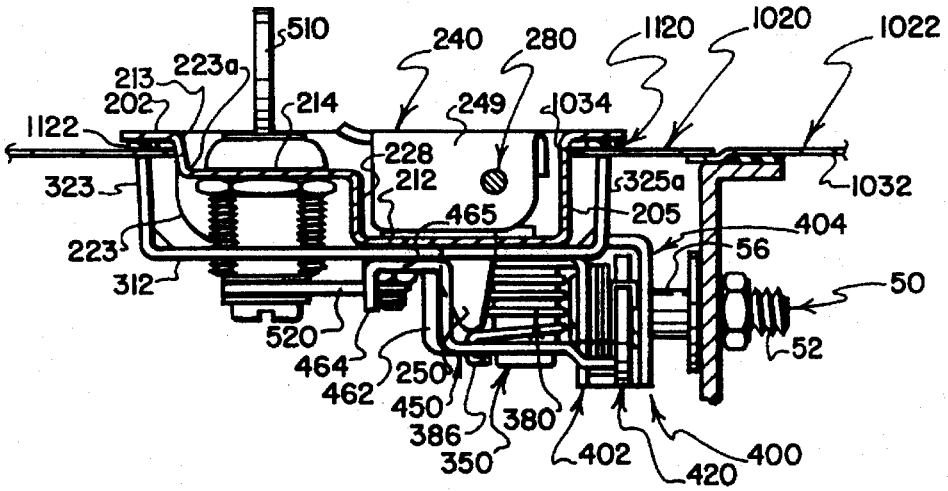

Referring to FIGS. 1–11, a handle operable rotary latch and lock unit 100 is shown mounted on a cabinet door or closure 20. Referring to FIGS. 16 and 17, the latch and lock unit 100 is shown mounted on a cabinet door or closure 1020. The closures 20, 1020 are typically formed from stamped metal sheets 32, 1032, or as assemblies of plural metal sheets (not shown), with generally rectangular openings 34, 1034 (see FIGS. 5, 8, 11 and especially FIG. 12 for opening 34, and FIG. 17 for opening 1034) being provided through the sheets 32, 1032 (through which portions of the lock unit 100 project). The closures 20, 1020 are movable between open and closed positions with respect to adjacent cabinet structure 22, 1022 (portions of which are depicted in FIGS. 1, 5, 8, 11, and in FIG. 17, respectively).

Figure 13:
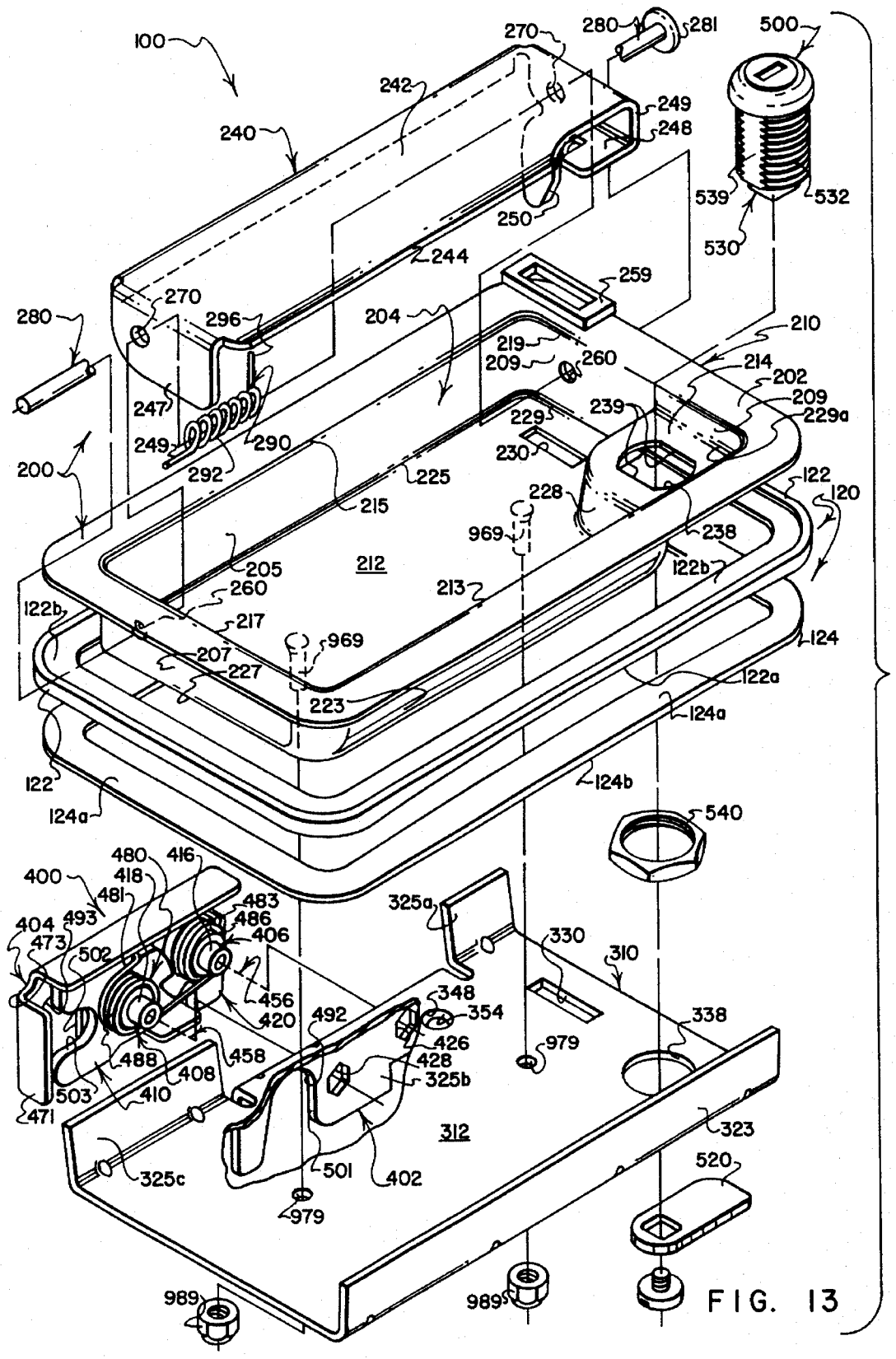

While the metal sheet 32 of the closure 20 is slightly curved in the vicinity of the opening 34, the metal sheet 1032 of the closure 1020 is substantially flat. To enable identical latch and lock units 100 to be used with not only the curved closure 20 but also with the flat closure 1020 while, at the same time permitting good, weather-tight seals to be formed between the units 100 and the closures 20, 1020 (i.e., about the openings 34, 1034), gasket sets indicated generally by the numerals 120, 1120 are provided. Referring to FIG. 13, the curved-mount gasket set 120 includes outer and inner gaskets 122, 124 that have curved surfaces **122*a*, 124*a* for engaging outer and inner sides of the curved metal sheet 32 adjacent the opening 34, and flat surfaces 122*b*, 124*b* that are engaged by outer and inner portions of the lock unit 100 that is mounted in the opening 34 (as will be explained)—whereby it will be understood that the outer and inner gaskets 122,124 are of non-uniform thickness in order to accommodate the curvature of the closure 20. In contradistinction, the flat-mount gasket set 1120 includes a simple, flat, conventional outer gasket 1122, which is all that usually to establish a weather-tight seal between the unit 100** and a flat closure.

Figure 3:
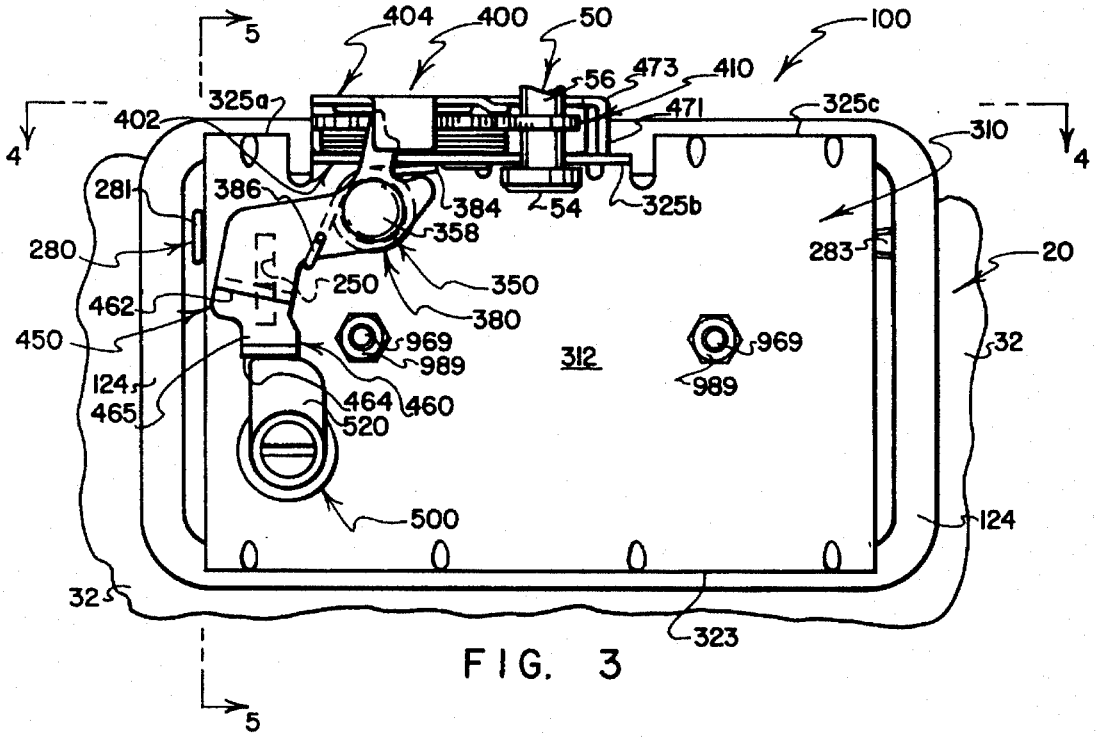
FIG. 3 is a bottom plan view of the unit, with relatively movable components thereof positioned as is depicted in FIG. 2, with a cam of a key-operated lock assembly shown in its locked position, and with portions or several components broken away.
Figure 4:
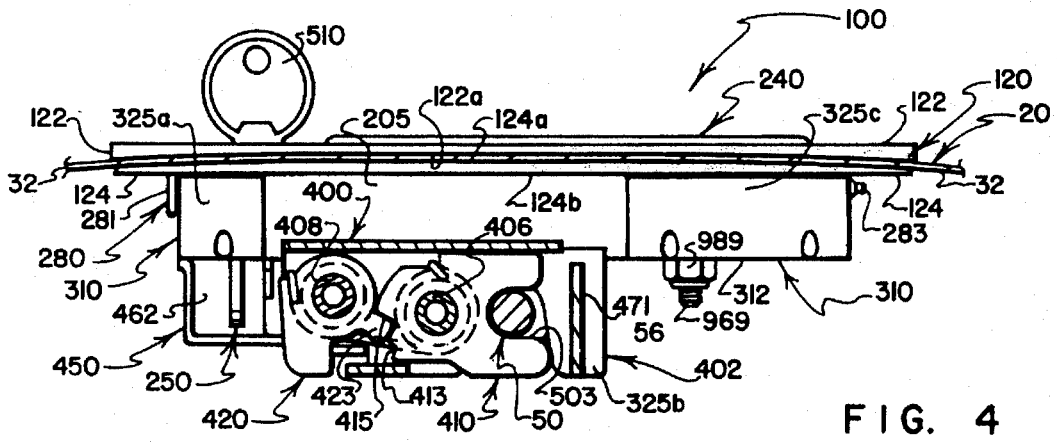
FIGS. 4 and 5 are sectional views as seen from planes indicated by lines 4—4 and 5—5 in FIG. 3, with relatively movable components of the unit positioned as is depicted in FIGS. 2 and 3, but with a key inserted in the key-operated lock assembly of the unit.
Figure 5:
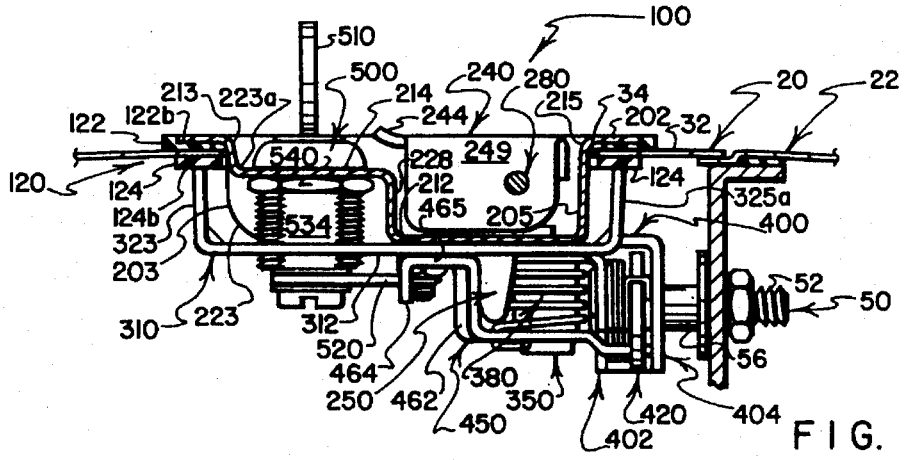

Because the only difference that exists between what is depicted in FIGS. 4 and 16, and between what is depicted in FIGS. 5 and 17 is the use of the differently configured gasket sets 120, 1120, it will not be necessary to continue to make reference to FIGS. 16 and 17. Thus, while the description that follows will principally refer to the latch and lock unit 100 as used with the curved door 20 (as depicted in FIGS. 1–15), it will be understood that, except for gasketing-related differences, such description also will be applicable to the latch and lock unit 100 as used with the flat door 1020 (as depicted in FIGS. 16 and 17).

Figure 1:
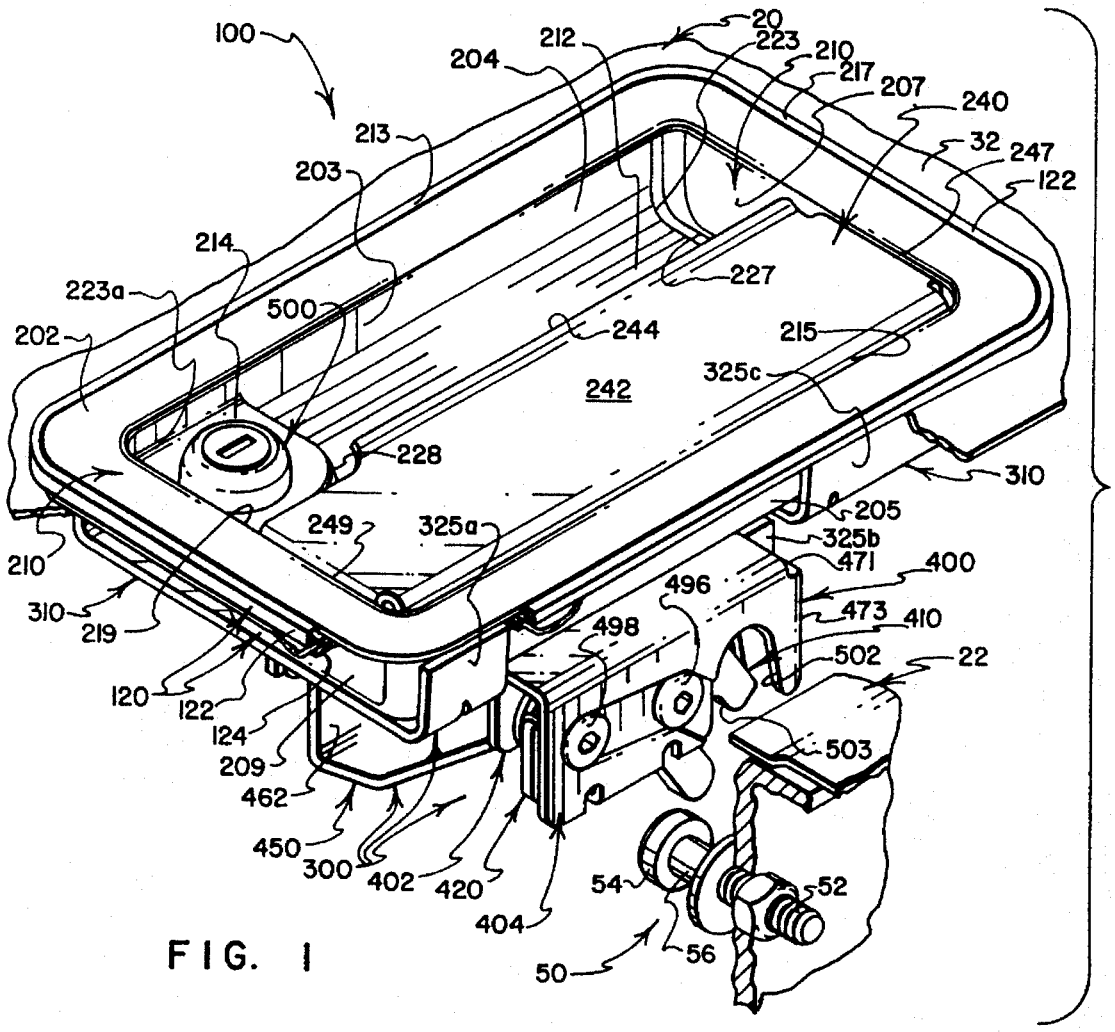
FIG. 1 is front perspective view of a handle operable rotary latch and lock unit installed on a closure of a cabinet and being operable to latchingly engage a strike that is installed on a part of the cabinet that is situated near the closure when the closure is closed, with an operating handle shown in its non-operated position, with a rotary jaw shown in its unlatched position ready to be slammed into latching engagement with the strike, and with portions of the cabinet and closure being broken away.
Figure 2:
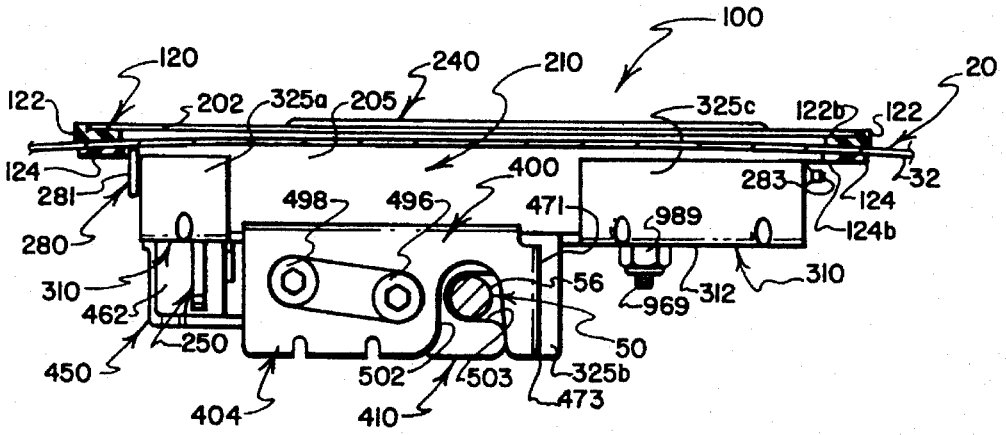
FIG. 2 is a side elevational view of the unit of FIG. 1, with the rotary jaw shown latchingly engaging portions of the strike, and with closure portions that extend adjacent the unit being shown in cross section.
Figure 7:
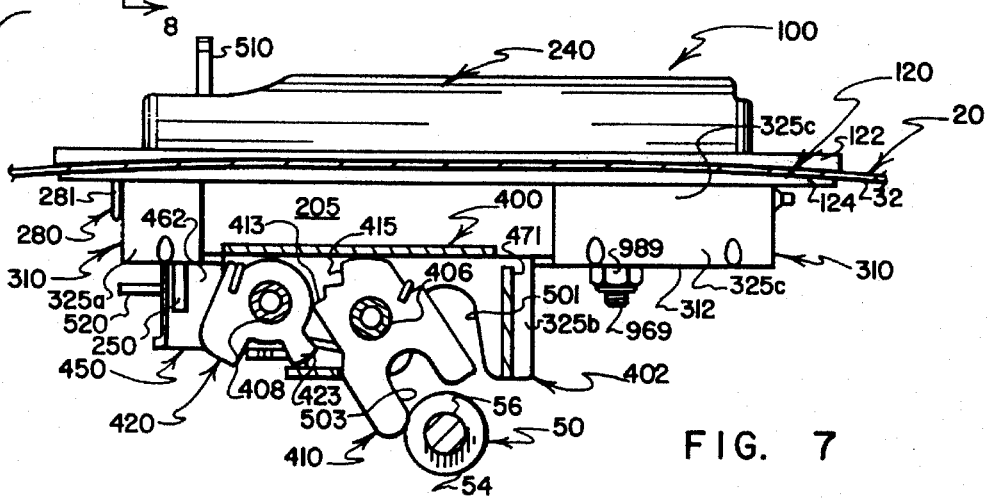
FIGS. 7 and 8 are sectional views as seen from planes indicated by lines 7—7 and 8—8 in FIG. 6, with relatively movable components of the unit positioned as is depicted in FIG. 6, and with the strike disengaged from the rotary jaw.

Mounted on the cabinet structure 22 is a strike 50 (best seen in FIGS. 1, 7, 8 and 12). While a strike that is suitably configured for use with the rotary latch and lock unit 100 can take a wide variety of forms, the elongate, "headed and threaded pin" form that is depicted in FIGS. 1, 7, 8 and 12 ordinarily is preferred. On one end of the strike 50, threads 52 are provided. On the opposite end of the strike 50, an enlarged diameter head 54 is formed. A generally cylindrical central region 56 is interposed between the threads 52 and the head 54, and provides an example of what is referred to herein as a "suitably configured strike formation." The cylindrical central region 56 1) is "slammable" into latching engagement with the rotary jaw 410 (when the rotary jaw 410 is "unlatched," as is best seen in FIGS. 1 and 7); 2) is receivable within a U-shaped notch 503 of the rotary jaw 410 (see, for example, FIGS. 2, 4 and 10); and, 3) cooperates with the rotary jaw 410 to latch the door 20 in its closed position (see, for example, FIGS. 2, 4 and 5).

Figure 8:
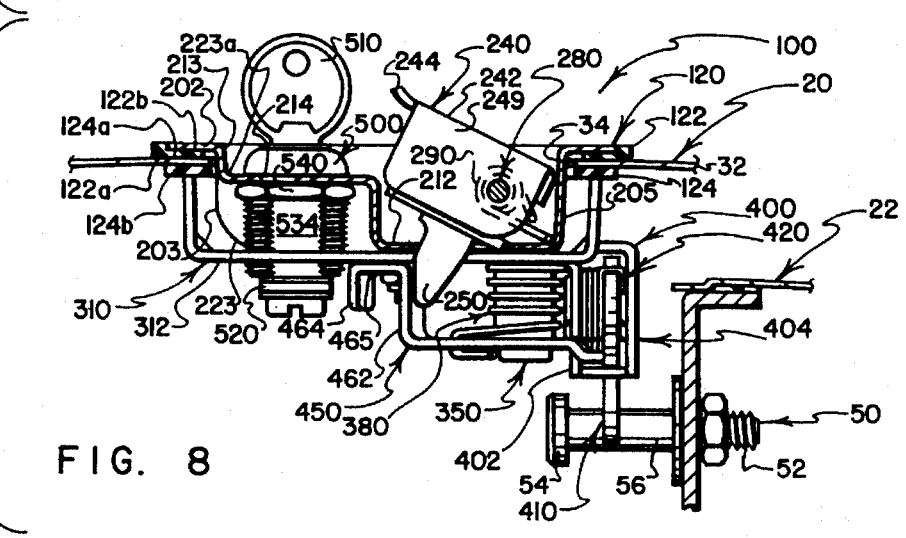
Figure 9:
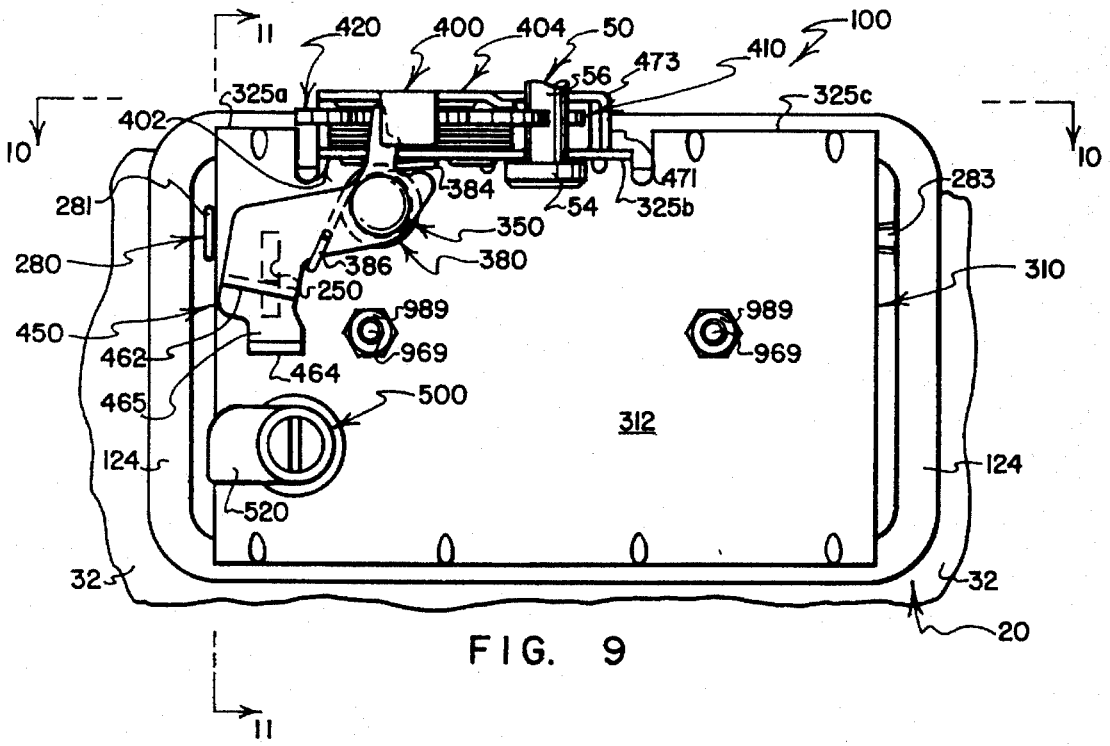
FIG. 9 is a bottom plan view similar to FIG. 6 but with the rotary jaw in a preliminary stage of latching engagement that is experienced by the unit as the closure is moved toward its fully closed position.
Figure 10:
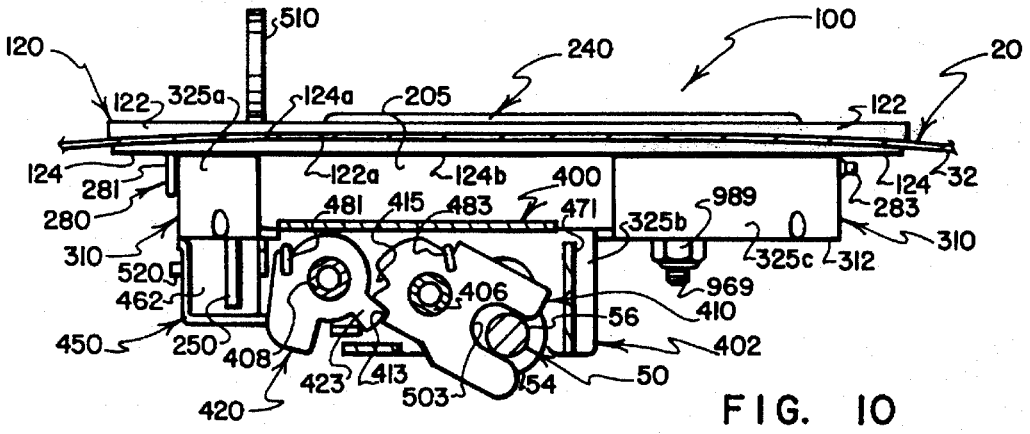
FIGS. 10 and 11 are sectional views as seen from planes indicated by lines 10—10 and 11—11 in FIG. 9, with relatively movable components of the unit positioned as is depicted in FIGS. 4 and 5 except for the angular positions of the rotary jaw and pawl of the unit.
Figure 11:
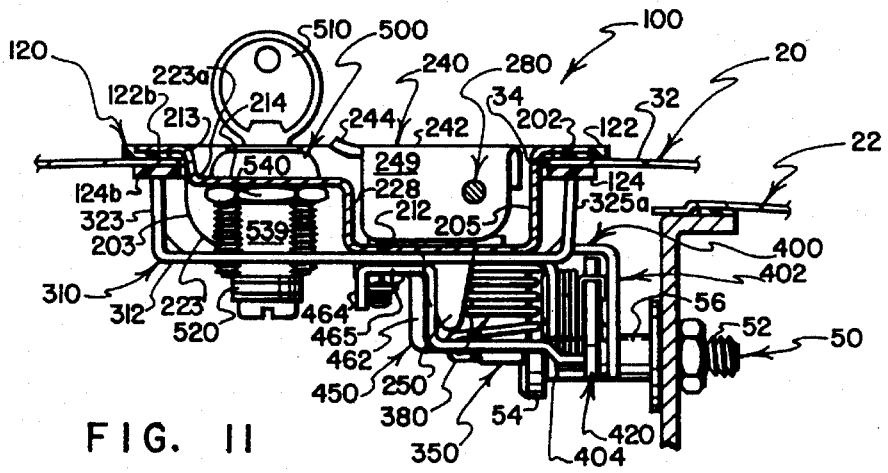

One of many possible "open" positions of the door 20 is depicted in FIG. 1, with another possible "open" position being depicted in FIGS. 7 and 8—wherein a rotary jaw 410 of the unit 100 is shown "unlatched" (i.e., the strike portion 56 is not being retained by the rotary jaw 410) and ready to be slammed into latching engagement with the strike 50 that is mounted on the cabinet structure 22. The "closed" position of the door 20 is depicted in FIGS. 2–5—wherein the rotary jaw 410 is shown receiving and latchingly retaining a generally cylindrical portion 56 of the strike 50. A "nearly closed" or "preliminarily latched" position of the door 20 is depicted in FIGS. 9–11—wherein the rotary jaw 410 is shown latchingly retaining the strike portion 56 to a sufficient degree that operation of the handle 240 is required to release a rotary pawl 420 from engaging the rotary jaw 410 to cause the spring-biased rotary jaw 410 to move from its "partially latched" position (best seen in FIG. 10) toward its unlatched position (best seen in FIG. 7).

Figure 12:
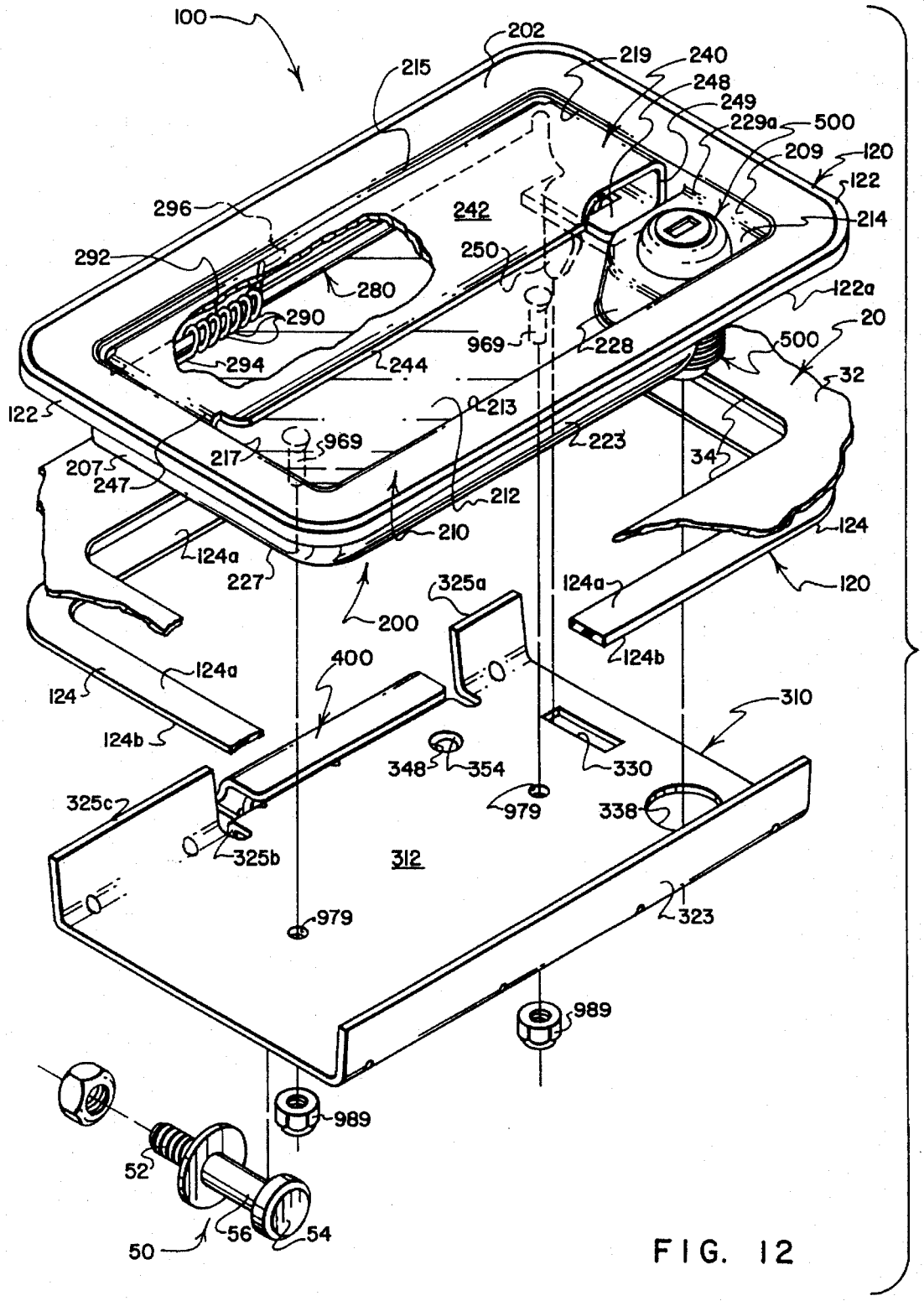
FIGS. 12, 13 and 14 are exploded front perspective views of selected components of the rotary latch and lock unit of FIGS. 1–11, with some components separated so as to be depicted individually, with other components shown assembled, and with some component portions broken away to permit underlying features to be viewed.
Figure 14:
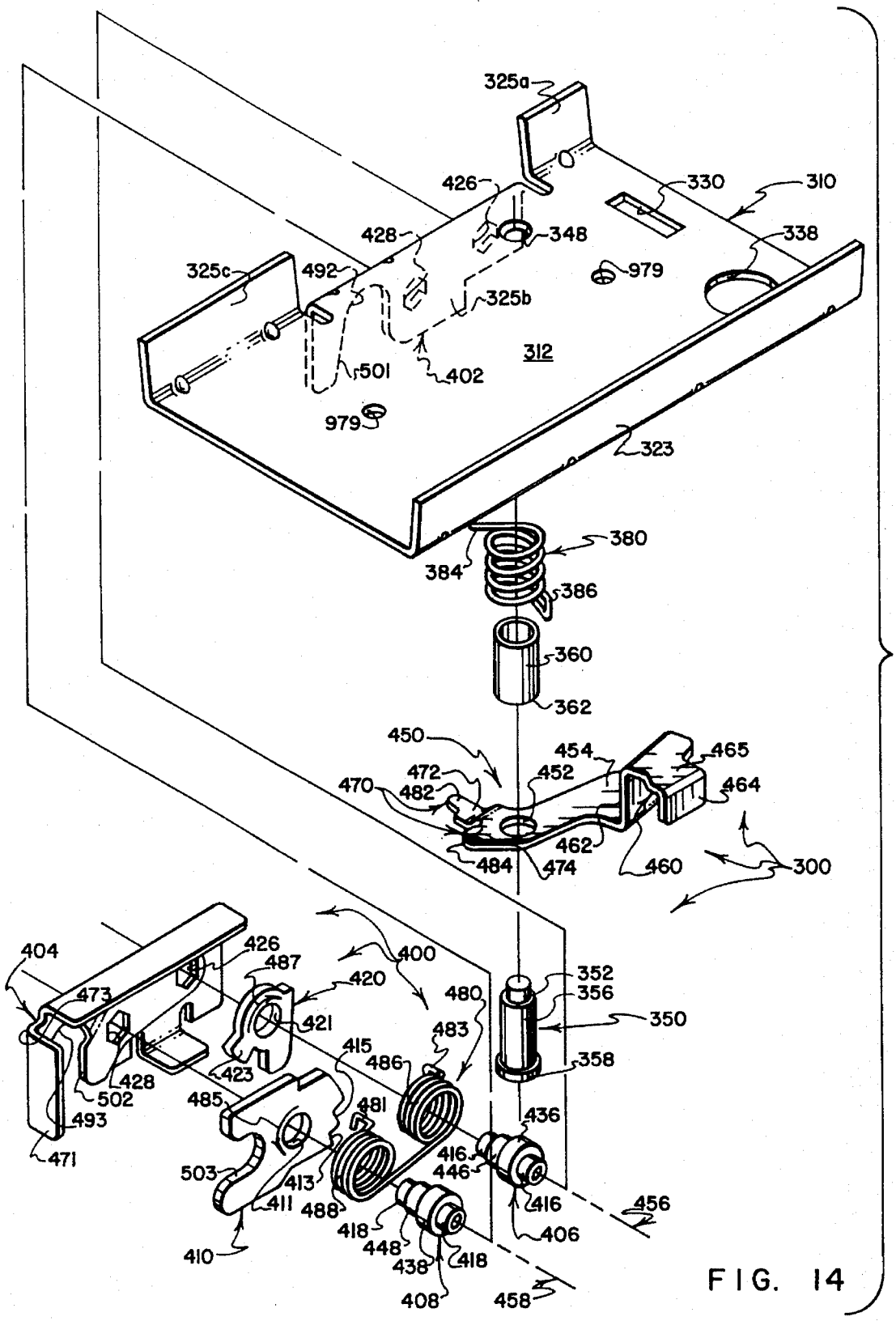
Figure 15:
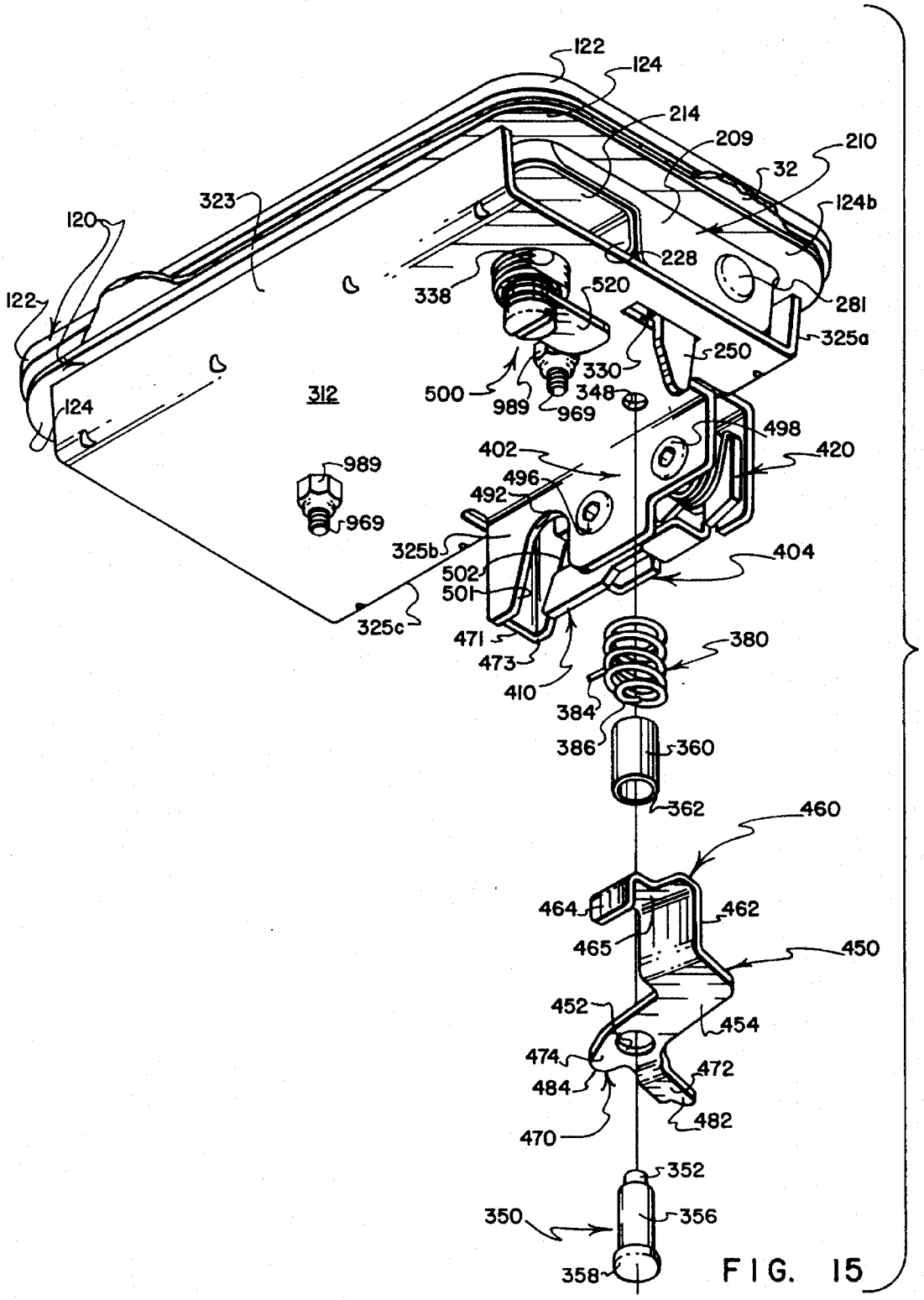
FIG. 15 is an exploded rear perspective view showing selected components of the unit of FIGS. 1–14, with some components separated so as to be depicted individually, and with other components shown assembled.

Three modular assemblies 200, 300, 500 form the latch and lock unit 100. Referring to FIGS. 12 and 13, a pan-shaped housing 210, a paddle-shaped handle 240, a hinge pin 280, and a torsion coil spring 290 comprise what will be referred to as a "front mountable modular assembly" or "handle and housing assembly" 200. Referring to FIGS. 13 and 14, a mounting bracket 310, a rotary latch subassembly 400, and an operating arm 450 comprise what will be referred to as a "rear mountable modular assembly" or "bracket, latch and linkage assembly" 300. Referring to FIGS. 12, 13 and 15, a "third modular assembly" takes the form of a conventional, commercially available, "key operated cam lock assembly" 500 that can be operated by a suitably configured key 510 (see FIGS. 4, 5, 7, 8 and 10 wherein the bow of the key 510 is shown projecting forwardly from the cam lock assembly 500).

Turning to features of the "front mountable modular assembly" or "handle and housing assembly" 200, and referring to FIGS. 1, 12 and 13, the pan-shaped housing 210 is a generally rectangular metal stamping having a perimetrically extending, substantially flat mounting flange 202 which surrounds a forwardly facing recess 204. Opposed, relatively long side walls 203, 205, and opposed, relatively short end walls 207, 209 are joined by small radius bends 213, 215, 217, 219 to the flat mounting flange 202.

A majority of the recess 204 is relatively deep, and is closed by a main back wall portion 212 that is substantially flat. A corner region of the recess 204 located near the juncture of the side and end walls 203, 209 is more shallow, and is closed by a minor back wall portion 214 that also is substantially flat. Relatively small radius bends **223*a* (FIG. 5), 229*a* (FIGS. 12–13) join portions of the side and end walls 203, 209 to the minor back wall portion 214. A curved wall 228 joins the minor back wall portion 214 to the main back wall portion 212, with small radius bends being provided where the curved wall 228 joins with the back wall portions 212, 214. Referring variously to FIGS. 1, 12 and 13, relatively small radius bends 225, 227, 229 join portions of the side and end walls 205, 207, 209 to the main back wall portion 212. A relatively larger radius bend 223 joins portions of the side wall 203 to the main back wall portion 212**.

Referring to FIG. 13, a main back wall opening 230 is formed through the main back wall portion 212; and, a lock mount opening 238 is formed through the minor back wall portion 214. The main back wall opening 230 is elongate, generally rectangular, is spaced a short distance from the housing end wall 229, and extends parallel to the housing end wall 229. The lock mount opening 238 is generally circular except for two flats 239 formed along opposite sides thereof.

Referring principally to FIGS. 12 and 13, the paddle-shaped handle 240 has a generally rectangular front wall 242 with a forwardly-turned lip 244 formed along one edge. Rearwardly-turned end flanges 247, 249 border opposite ends of the rectangular front wall 242 and extend alongside the housing end walls 207, 209, respectively. The end flange 249 has an inwardly-turned extension 248 that parallels the front wall 242 of the handle 240, and that carries a rearwardly projecting tab-like formation 250 that extends through the main back wall opening 230. Referring to FIG. 12, an optional, generally rectangular gasket 259 may be provided to surround portions of the projection 250 at a location adjacent the back wall opening 230.

Referring to FIG. 13, the hinge pin 280 extends through aligned holes 260 that are formed through the end walls 207, 209 of the pan-shaped housing 210, and through aligned holes 270 that are formed through the rearwardly-turned flanges 247, 249 of the paddle-shaped handle 240 to pivotally mount the handle 240 on the housing 210. A head 281 is formed on one end of the pin 280. While the opposite end of the pin initially is pointed (as depicted in FIG. 13) to facilitate assembly, once the pin 280 has been inserted through the holes 260, 270 to pivotally mount the handle 240 on the housing 210, a crimp 283 is formed (see FIGS. 3 and 4) to prevent removal of the pin 280 from the holes 260, 270.

Referring to FIGS. 12 and 13, the torsion coil spring 290 has a coiled central region 292 that extends loosely about the hinge pin 280 at a location between the rearwardly-turned flanges 246 of the handle 240, and has opposed end regions 294, 296 that engage the back wall 212 and the handle 240, respectively, to bias the handle 240 away from its "extended" or "operated" position (see FIGS. 7 and 8) toward its "nested" or "non-operated" position (see FIGS. 1, 5 and 12).

When the operating handle 240 is moved away from its nested, non-operated position toward its extended, operated position (by pivoting about the axis of the pin 280), the rearwardly extending handle tab projection 250 is caused to move within the back wall opening 230 (from a normal or "first" position that is depicted in FIG. 5 to a "second" position that is depicted in FIG. 8). As will be explained shortly, this movement of the tab 250 within the confines of the back wall opening 230 causes the operating arm 450 to "unlatch" the rotary latch subassembly 400 from latchingly engaging the strike 50 by moving from a normal or "primary" position of the operating arm 450 (depicted in FIG. 3) to a "secondary" position of the operating arm 450 (depicted in FIG. 6).

Turning now to features of the "rear mountable modular assembly" or "bracket, latch and linkage" assembly 300, and referring to FIGS. 12–15, the mounting bracket 310 has a relatively flat, generally rectangular-shaped central region 312 with a forwardly turned side flange 323 (configured to extend the full length along the housing side wall 203 when the front and rear modules 200,300 are assembled), and with forwardly turned side flange portions 325*a*, 325*c* (configured to extend along portions of the housing side wall 205 at locations on opposite sides of the rotary latch subassembly 400 when the front and rear modules 200, 300 are assembled). At a location between the forwardly turned flange portions 325*a*, 325*c*, the mounting bracket also defines a rearwardly turned flange 325*b*. The rearwardly turned flange 325b forms a part of the rotary latch subassembly 400, as will be explained below.

Referring to FIGS. 12–15, an elongate, generally rectangular opening 330 is formed through the flat central portion 312 of the mounting bracket 310 to align with the main back wall opening 230 when the mounting bracket 310 is mounted together with the handle and housing assembly 200 on the closure 20—which alignment is provided to enable the rearwardly projecting formation 250 of the handle 240 to extend through the opening 330 to engage the operating arm 450. A feature that is provided by the closely spaced, aligned housing and mounting bracket openings 230, 330 is that they cooperate to protectively enshroud the rearwardly projecting formation 250 to prevent it from bending or breaking either during normal service or as the result of tampering.

Optionally formed through the flat central portion 312 of the mounting bracket 310 is a circular opening 338 that is located to align with the lock mounting opening 238 of the pan-shaped housing 210 to permit the lock assembly 500 to pass therethrough in a close fit. A feature that is provided by the close fit of the circular opening 338 about body portions of the lock assembly 500 is that the material of the mounting bracket 310 that extends about the opening 338 will help to reinforce and rigidify the mounting of the lock assembly 500 in the lock mounting opening 238 to prevent damage from occurring due either to extensive normal service or as the result of tampering or forcing of the lock 100.

Referring to FIG. 14, a tapered hole 348 is formed through the flat central portion 312 of the mounting bracket 310 to receive a reduced diameter end region 352 of a mounting post 350. The mounting post 350 is rigidly attached to the mounting bracket 310 by deforming and expanding the reduced diameter end region 352 to form an enlarged head 354 that substantially fills the tapered hole 348, as is depicted in FIGS. 12 and 13.

Figure 6:
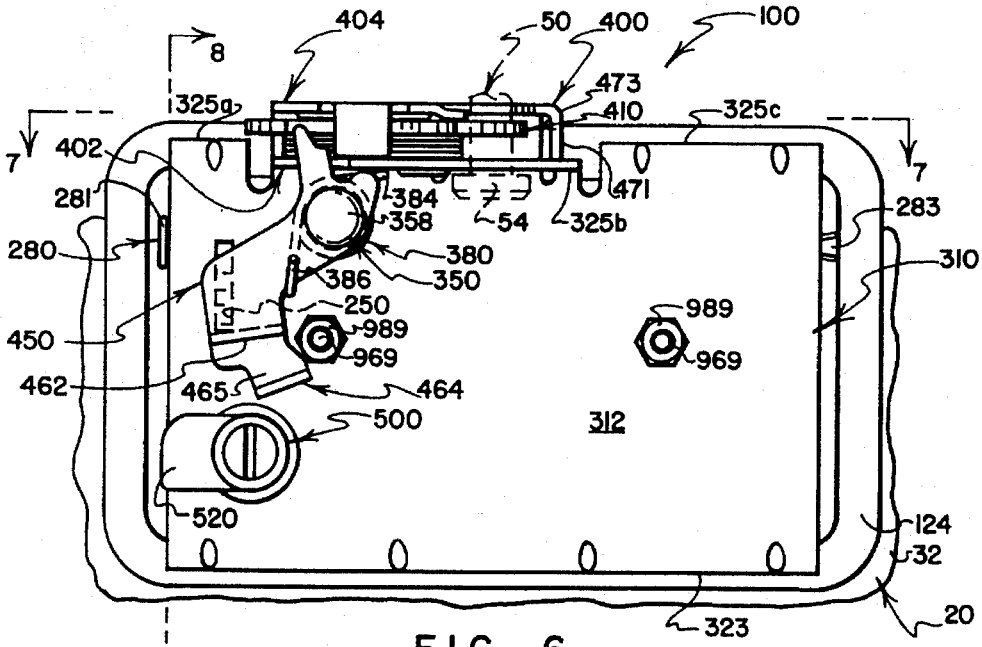
FIG. 6 is a bottom plan view similar to FIG. 3 but with the cam of the lock assembly in its unlocked position, and with an operating handle of the unit in an operated position that causes an operating arm to unlatch the rotary jaw for movement out of its latched position.

Referring to FIGS. 14 and 15, the mounting post 350 has a generally cylindrical central region 356 that extends rearwardly to where an enlarged head 358 is formed. A sleeve 360 is mounted in a slip fit on the central region 356 and extends rearwardly from the flat central wall 312 of the mounting bracket 310 to define an end 362 that is spaced a short distance from the head formation 358. The operating arm 450 has a mounting hole 452 that is sized to receive the central region 356 in a slip fit (that will permit the operating arm 450 to pivot smoothly relative to the mounting post 350 between the "primary" position of the operating arm 450 which is depicted in FIG. 3 and the "secondary" position of the operating arm 450 which is depicted in FIG. 6). The operating arm 450 is mounted on the mounting post 350 at a location between the head formation 358 and the end 362 of the sleeve 360, with the central region 356 extending through the mounting hole 452.

Referring still to FIGS. 14 and 15, a torsion coil spring 380 has coils 382 located between opposite ends 384, 386. The coils extend about the sleeve 360 to mount the spring 380 on the mounting post 350 at a location between the flat wall 312 of the mounting bracket 310 and the operating arm 450. Referring to FIGS. 3, 6 and 9, the spring end 384 extends away from the mounting post 350 to engage the rearwardly turned mounting flange portion 325*b*, while the spring end 386 engages the operating arm 450 to bias the operating arm 450 (in a clockwise direction as viewed in FIGS. 3, 6 and 9 away from the "secondary" position of the operating arm 450 depicted in FIG. 6 toward the "primary" position of the operating arm 450 depicted in FIG. 3).

Referring again to FIGS. 14 and 15, the operating arm 450 has a rather complex dog-legged configuration that includes a substantially flat, elongate central region 454 (through which the mounting hole 452 is formed) that extends between one end where a U-shaped formation 460 is provided, and an opposite end where a forked or Y-shaped formation 470 is provided.

The U-shaped formation 460 is defined by first and second forwardly-rearwardly extending legs 462, 464 that are interconnected near their forward ends by a base leg 465. The U-shaped formation 460 serves the dual functions 1) of providing the leg 462 to be engaged by the rearwardly projecting formation 250 of the handle 210 (so that the operating arm 450 will be moved by the rearwardly projection formation 250 when the handle 240 pivots about its mounting pin 280), and 2) of providing the leg 464 to be selectively engaged and disengaged by a cam 520 of the lock mechanism 500 (to "lock" and "unlock" the unit 100 in response to operation by the key 510 of the lock assembly 500).

The forked or Y-shaped formation 470 is defined by first and second branches 472, 474 that diverge to define at their ends, a pawl-engaging formation 482 and a stop formation 484, respectively. The Y-shaped formation 470 serves the dual functions 1) of providing the pawl-engaging formation 482 for engaging the pawl 420 of the rotary latch subassembly 400 for operating the pawl 420 (in a manner that will be described below) when the operating arm 450 is pivoted about the mounting post 350 from the position depicted in FIG. 3 to the position depicted in FIG. 6, and 2) of providing the stop formation 484 for engaging the rearwardly turned flange portion 325*b* of the mounting bracket 310 to "stop" pivotal movement of the operating arm 450 (caused by the projection 250 being pivoted with the handle 240 about the axis of the mounting pin 280) to the position depicted in FIG. 6.

Turning to features of the rotary latch subassembly 400 (that forms a part of the bracket, latch and linkage assembly 300), and referring to FIGS. 13 and 14, the subassembly 400 has what will be referred to as a "housing" that consists of first and second "housing side plates" 402, 404. The side plate 402 is not an independent member, but rather is defined by the rearwardly turned flange 325*b*—and thus is an integral part of the one-piece mounting bracket 310. The side plate 404 is formed as separate stamping, and is held in spaced, parallel relationship to the side plate 402 by first and second spacers or bushings 406, 408.

Referring to FIG. 14, the first and second bushings 406, 408 are tubular (i.e., they have hollow interiors), and have reduced diameter end regions 416, 418 that are sized to be received in a slip fit within hex-shaped holes 426,428 (see also FIG. 13) that are formed in the side plates 402, 404, respectively. To securely retain the hollow, reduced diameter end regions 416, 418 in the hex-shaped holes 426, 428 (to thereby rigidly interconnect the housing side plates 402, 404), the end regions 416, 418 are deformed and enlarged to form heads 496, 498 (see FIGS. 1 and 15) that have hollow interiors that tend to be of slightly hex shape after the end regions 416, 418 have been properly deformed to fully engage the sides of the hex-shaped holes 426, 428. Because the holes 426, 428 are hex-shaped, and because the hollow end regions 416, 418 are expanded (during formation of the heads 496, 498) to fully fill the hex-shaped holes 426, 428, good, secure, rotation-resistant connections are formed that rigidly interconnect the side plates 402, 404 and that resist loosening and rotation of the bushings 406, 408 relative to the side plates 402, 404.

Referring still to FIG. 14, the bushings 406, 408 are generally cylindrical, and provide stepped central regions that have relatively large diameter portions 436, 438 and relatively medium diameter portions 446, 448, respectively. The end and central regions 416, 436, 446 of the bushing 406 are concentric about a first transversely extending axis that is designated by the numeral 456. The end and central regions 418, 438, 448 of the bushing 408 are concentric about a second transversely extending axis that is designated by the numeral 458. Optional internal threads (not shown) may be formed within hollow interiors of the bushings 406, 408 to permit threaded fasteners of suitable size (not shown) to be connected to the subassembly 400 (should this be desirable for some purpose).

Referring to FIGS. 13 and 14, the side plates 402, 404 define aligned first and second U-shaped notches 501, 502, respectively, that open rearwardly with respect to the closure 20 so that, as the closure 20 is moved toward its closed position, the resulting rearward movement of the side plates 402, 404 by the closure 20 will cause the central region 56 of the strike 50 to be received within the first and second U-shaped notches 501, 502 (see FIG. 3). Referring to FIGS. 4, 10, 13 and 14, a cooperating third U-shaped notch 503 is formed in the rotary jaw 410, and functions in concert with the first and second U-shaped notches 501, 502 to receive and latchingly retain the central region 56 of the strike 50 therein when the closure 20 is closed.

A feature of the preferred practice of the present invention resides in the utilization of the second U-shaped notch 502 (either alone or in concert with the first U-shaped notch 501) to define a strike engagement surface (or surfaces) that is (are) directly engageable by the central region 56 of the strike 50. If the first and second U-shaped notches 501, 502 are identically configured and positioned to extend in congruent alignment, a pair of congruently aligned strike engagement surfaces 492, 493 are defined by the notches 501, 502—which are engageable by the central region 56 of the strike 50 as the central region 56 moves into and is latchingly retained within the U-shaped notches 501, 502. If, on the other hand, the first U-shaped notch 501 is configured such that it is wider than the second U-shaped notch 502 (so that the surfaces that define the first notch 501 are positioned such that they cannot physically engage the strike 50), the only strike engagement surface that will be defined by either of the notches 501, 502 is the strike engagement surface 493 that is defined by the second U-shaped notch 502.

By always ensuring that the strike engagement surface 493 is defined by the second U-shaped notch 502 (regardless of whether an additional strike engagement surface 492 is defined by the first U-shaped notch 501), advantage will always be taken of the close proximity presence to the second notch 502 (and to the strike engagement surface 493) of a transversely extending reinforcing flange 471 that is formed integrally with the second side plate 404 near one end thereof. A tight radius bend 473 connects the flange to a narrow portion 475 (see FIGS. 1 and 2) of the second side plate 404 that extends along one side of the second notch 502 (and that defines the strike engagement surface 493). The close proximity presence of the transversely extending flange 471 and the bend 473 to the second notch 502 (and to the strike engaging surface 493 that is defined by the second notch 502) strengthens and rigidifies the second housing side plate 404 in the critical area adjacent the strike engaging surface 493.

While the second U-shaped notch 502 could be configured such that it is wider than the first U-shaped notch 501 (whereby the only strike engagement surface that would be defined by either of the notches 501, 502 is the strike engagement surface 492 that is defined by the first U-shaped notch 501), this option does not conform to the preferred practice of the present invention unless the first side plate 402 is provided with a transversely extending flange (not shown) that is substantially identical to the depicted flange 471, but which extends from the first side plate 402 toward the second side plate 404 to bridge the space therebetween (instead of extending from the second side plate 404 toward the first side plate 402 to bridge the space therebetween, as does the depicted flange 471).

Referring to FIG. 14, housed between the side plates 402, 404 are the rotary jaw 410 and the rotary pawl 420. The rotary jaw 410 has a mounting hole 411 that receives the bushing diameter 448 therein in a slip fit to mount the rotary jaw 410 on the bushing 408 for limited angular movement about the transversely extending axis 458. The rotary pawl 420 has a mounting hole 421 that receives the bushing diameter 446 therein in a slip fit to mount the rotary pawl 420 on the bushing 406 for limited angular movement about the transversely extending axis 456.

Also housed between the side plates 402, 404 is a torsion coil spring 480 that has a first coil 486 that extends about the diameter 436 of the bushing 406, and a second coil 488 that extends about the diameter 438 of the bushing 408. An end 481 of the spring 480 engages the rotary jaw 410 for biasing the rotary jaw 410 in a direction of angular movement about the axis 458 that is indicated by an arrow 485. An opposite end 483 of the spring 480 engages the rotary pawl 420 for biasing the rotary pawl 420 in a direction of angular movement about the axis 456 that is indicated by an arrow 487.

Referring to FIGS. 7 and 10, the rotary jaw 410 and the rotary pawl 420 are provided with engageable formations 413, 423, respectively, that cooperate to "preliminarily latch" the rotary jaw 410 in engagement with the central region 56 of the strike 50 after the strike 50 has moved only a short distance into the aligned first and second U-shaped notches 501, 502 during movement of the closure 20 toward its closed position.

Referring to FIG. 4, the rotary jaw 410 and the rotary pawl 420 also are provided with engageable formations 415, 423, respectively, that cooperate to "fully latch" the rotary jaw 410 in engagement with the central region 56 of the strike 50 after the strike 50 has moved as far as it is going to move into the aligned first and second U-shaped notches 501, 502 as the closure 20 is moved to its fully closed position. When the engageable formations 415, 423 are engaged (as is depicted in FIG. 4), the rotary jaw 410 is prevented by the rotary pawl 420 from executing unlatching movement until the rotary pawl 420 is rotated about the axis 456 to a pawl-releasing position wherein the engageable formations 415, 423 disengage to permit the rotary jaw 410 to rotate away from its fully latched position toward its unlatched position wherein the strike 50 is free to move out of the third U-shaped notch 503 that is defined by the rotary jaw 410. This type of pawl-controlled jaw latching action is well known to those who are skilled in the art, and is further illustrated and described in the patents that are identified above.

To move the rotary pawl 420 in opposition to the action of the torsion coil spring 480 (i.e., in a direction opposite the arrow 487) from a pawl-retaining position (depicted in FIG. 4) to a pawl-releasing position (depicted in FIG. 7), the operating arm 450 is pivoted (about the mounting post 350 from the "primary" position depicted in FIG. 3 to the "secondary" position depicted in FIG. 6—which can only be done if the lock mechanism 500 has been operated to position the cam 520 in its unlocked position, as shown in FIG. 6) by operating the handle (to pivot the handle 240 about the axis of the pin 280 from its normal non-operated position shown in FIGS. 1 and 5 to its operated position shown in FIGS. 7 and 8). When the operated handle 240 is released, it returns to its non-operated position under the influence of the spring 290, hence the rearward extending projection 250 no longer remains in the "second" position of FIG. 8 where it holds the operating arm 450 in its "secondary" position (shown in FIG. 6). As the projection 250 returns to the "first" position of FIGS. 1 and 5, the operating arm 450 is caused to return to its "primary" position (shown in FIG. 3) due to the biasing action of the spring 380.

So long as the rotary jaw 410 of the unit 100 is in its unlatched position (depicted in FIGS. 1 and 7), the rotary jaw 410 always can be slammed into latching engagement with the strike 50. This is true regardless of how other relatively movable components of the unit 100 may be positioned. As the rotary jaw 410 receives the strike 50 within its third. U-shaped notch 503, and as the strike 50 moves into the aligned first and second U-shaped notches 501, 502 of the housing side plates 402, 404, the strike 50 becomes cooperatively confined by the combined action of the first, second and third notches 501, 502, 503. When the strike 50 reaches the position that is depicted in FIG. 10, the rotary pawl 420 and the rotary jaw 410 become "preliminarily latched" (i.e., the engagement formations 413, 423 engage to prevent unlocking of the rotary jaw 410). When the strike 50 reaches the fully latched position depicted in FIG. 4, the engagement formations 415, 423 engage to fully lock the closure 20 in its closed position.

Referring to FIGS. 12 and 13, to securely connect the "handle and housing assembly" or "front module" 200 to the "bracket, latch and linkage assembly" or "rear module" 300 (so that the assemblies 200, 300 will be securely retained in place on the closure 20), threaded studs 969 are provided that project rearwardly from the back wall 212 of the pan-shaped housing 210 through openings 979 that are formed through the flat wall 312 of the mounting bracket 310, and lock nuts 989 are threaded onto the studs 969 and tightened in place so that the gasket set 120 or 1120 that extends about the mounting opening 34 or 1034 is compressed to form a weather tight seal as the front and rear assemblies are securely connected by the fasteners 969, 989. By this arrangement, the assemblies 200, 300 are quickly, easily and yet securely connected and fastened in place on the closure, with proper alignment and registry of the assemblies 200, 300 being ensured.

Referring to FIGS. 12 and 13, the key-operated cam lock assembly 500 is a commercially purchased assembly available from a wide variety of sources, and is selected to provide a quarter-turn for the cam 520, with the key 510 (see, for example, FIGS. 4 and 5) preferably being removable in both the "locked" position of the cam 520 (depicted in FIG. 3) and the "unlocked" position of the cam 520 (depicted in FIG. 6). Referring to FIG. 13, the assembly 500 has a housing 530 with threaded exterior portions 532, and with opposed flat surfaces 539 (only one of which is shown in FIG. 13) that engage the flats 239 of the lock mount opening 238 to prevent the housing 530 from rotating relative to the pan-shaped housing 210. A nut 540 is threaded onto the threaded exterior portions 532 of the body 530 to hold the lock assembly 500 in place on the pan-shaped housing 210.

So long as the key-locking assembly 500 positions the cam 520 in its "unlocked" position, as is depicted in FIGS. 6, 8, 9 and 11, pivotal movement of the operating arm will not be impeded by the cam 520—hence, the operating handle 240 can be pivoted out of its nested, non-operated position (shown in FIG. 5) to its extended, operated position (shown in FIG. 8) to cause the tab 250 to pivot the operating arm to pivot the rotary pawl 420 away from its normal jaw-retaining position (shown in FIG. 4) toward its jaw-releasing position (shown in FIG. 7) to release the pawl formation 423 from engaging either of the jaw formations 413, 415, whereupon the rotary jaw 420 pivots under the influence of the spring 480 away from its latched position (shown in FIG. 4) to its unlatched position (shown in FIG. 7) to release the strike 50.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A flush-mountable, handle-operable rotary latch for mounting on a closure for releasably retaining the closure in a closed position by latchingly engaging a suitably configured strike formation that is located within relatively close proximity to the rotary latch when the closure is in its closed position, comprising:

a) flush-mountable front assembly means for mounting as a first modular assembly on a closure adjacent a mounting opening that is formed through a front wall of the closure, including:

i) first housing means including a pan-shaped housing for mounting on the closure adjacent the mounting opening, including a one-piece housing that defines:

A) mounting flange means for defining a front wall of the pan-shaped housing, including a mounting flange that is configured 1) to extend perimetrically about the closure's mounting opening, 2) to closely overlie portions of a front surface of the closure's front wall that extend perimetrically about the mounting opening, and 3) to be clamped toward engagement with said portions of the closure's front surface to substantially flush-mount the pan-shaped housing on the closure;

B) side walls and a back wall that cooperate to define a forwardly-facing recess, 1) with the side walls being configured to extend forwardly and rearwardly through the closure's mounting opening when the mounting flange closely overlies said portions of the closure's front surface, 2) the side walls having front portions that join smoothly with and being perimetrically surrounded by the mounting flange, 3) the side walls having rear portions that join smoothly with portions of the back wall, 4) with said portions of the back wall being configured to extend substantially parallel to the front wall of the pan-shaped housing, 5) with said portions of the back wall having a front surface that faces forwardly into the recess and a rearwardly-facing back surface on the opposite side thereof, and 6) with a main back wall opening formed through said portions of the back wall;

ii) handle means including an operating handle that is at least partially nested within the recess, and that is connected to the first housing means for movement relative to the pan-shaped housing between a non-operated position and an operated position; and, iii) projection means connected to the handle and extending rearwardly through the opening formed in the back wall for being moved by movement of the handle 1) such that, when the handle is in the non-operated position, the projection means is caused by its connection to the handle to be in a first position, such that, 2) when the handle is moved from the non-operated position to the operated position, the projection means is caused by such movement to move from the first position to a second position, and such that, 3) when the handle is moved from the operated position to the non-operated position, the projection means is caused by such movement to move from the second position to the first position;

b) rear assembly means for mounting as a second modular assembly on the closure, for being connected to the front assembly means to clampingly draw the mounting flange toward engagement with said portions of the closure's front surface to securely mount the rotary latch on the closure, including:

i) mounting bracket means including a mounting bracket having a rear wall for overlying at least a portion of the back surface of the back wall of the pan-shaped housing, for bridging at least a portion of the closure's mounting opening at a location behind the back surface of the closure's front wall, for being fastener-connected to the front assembly means, and for defining back-surface engaging means for being clamped toward engagement with the back surface of the closure's front wall when the mounting flange of the first housing means is being clamped toward engagement with said portions of the closure's front surface;

ii) said mounting bracket means having a projection receiving opening formed therethrough through which said projection means extends when said back-surface engaging means is fastener-connected to the front assembly means, with said projection receiving opening having a first end and an opposed second end, and with said projection receiving opening further being configured such that, 1) when said projection means is in said first position, a rearwardly projecting part of said projection means is located near said first end, and such that, 2) when said projection means is in said second position, the rearwardly projecting part of said projection means is located near said second end;

iii) rotary means including second housing means rigidly connected to the mounting bracket means, with the second housing means including:

A) an elongate, generally rectangular first housing side plate having opposed end regions near opposite ends of the length thereof, and defining a first U-shaped notch located near one of the opposed end regions of the first housing side plate;

B) an elongate, generally rectangular second housing side plate having opposed end regions near opposite ends of the length thereof, and defining a second U-shaped notch located near one of the opposed end regions of the second housing side plate, with the second U-shaped notch being substantially aligned with the first U-shaped notch;

C) spacer means for extending transversely between, for rigidly connecting with, and for maintaining a substantially parallel relationship between the first and second housing side plates, with the spacer means including a first spacer that extends along a first transverse axis that intersects each of the first and second housing side plates at a location that is relatively near to the other end regions thereof, and with the spacer means also including a second spacer that extends along a second transverse axis that intersects each of the first and second housing side plates at a location that is substantially midway between the opposite ends thereof;

iv) with the rotary means additionally including a rotary jaw and a rotary pawl that extend substantially within a common plane located between the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with an operating arm being provided for moving the rotary pawl to release the rotary jaw from its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation, and with a selected one of the first and second housing side plates being strengthened and enhanced in rigidity by the close proximity presence of a transversely extending flange that is formed integrally with said selected housing side plate; and, v) with the operating arm of the rotary means being pivotally connected to the mounting bracket means, with a designated part of the operating arm extending into engagement with said rearwardly projecting part of the projection means for being moved by the rearwardly projecting part of the projection means to effect movement of the rotary pawl to release the rotary jaw from being retained in its latched position in response to movement of the operating handle away from its non-operated position toward its operated position to thereby release the striker from being concurrently received within and latchingly retained within the confines of the first, second and third U-shaped notches; and, c) fastener means for connecting and clamping toward each other the housing means and the mounting bracket means to thereby clamp the back-surface engaging means of the mounting bracket toward a position of engagement with the back surface of the closure's front wall, and to clamp the mounting flange of the pan-shaped housing toward a position of engagement with said portions of the closure's front surface.

2. The latch of claim 1 wherein the first and second U-shaped notches open generally in a direction that is substantially opposite to a direction of travel that is followed by the closure in moving away from its closed position toward an open position, with each of the first and second notches being defined, at least in part, by a pair of spaced-apart side surfaces that are smoothly interconnected by an associated curved surface, and with at least one of the associated curved surfaces having a radius of curvature that substantially matches the radius of curvature of a generally cylindrical strike formation portion that is received within the first, second and third U-shaped notches when the strike formation is latchingly engaged by the rotary latch.

3. The latch of claim 1 wherein the U-shaped notch that is defined by said selected housing side plate defines a strike engagement surface that is configured to be directly engaged by a strike formation that is received within the first, second and third U-shaped notches, said transversely extending flange is located in close proximity to the strike engagement surface, and said flange is connected to such portions of said selected housing side plate as define the strike engagement surface by a relatively small radius right angle bend, with said flange and said bend cooperating to rigidify and strengthen such portions of said selected housing side plate as define the strike engagement surface.

4. The latch of claim 1 wherein the first U-shaped notch is defined, at least in part, by an associated first strike engagement surface, the second U-shaped notch is defined, at least in part, by an associated second strike engagement surface, the first and second strike engagement surfaces are aligned so as to extend substantially congruently and are configured to be directly engaged by a strike formation that is received within the first, second and third U-shaped notches, said transversely extending flange is located in close proximity to a selected one of said associated strike engagement surfaces, said flange is connected to such portions of said selected housing side plate as define said selected associated strike engagement surface by a relatively small radius right angle bend, with said flange and said bend cooperating to rigidify and strengthen such portions of said selected housing side plate as define said selected associated strike engagement surface.

5. The latch of claim 1 wherein:

a) the first and second U-shaped notches open generally in a direction that is substantially opposite to a direction of travel that is followed by the closure in moving away from its closed position toward an open position;

b) the third U-shaped notch is defined by a portion of the rotary jaw that moves to sufficiently align the directions in which the first, second and third U-shaped notches open when the rotary jaw is in its unlatched position to permit movement of the strike formation into and out of the first, second and third U-shaped notches, and to cause the first, second and third U-shaped notches to progressively close about portions of a strike formation that are received therein as the rotary jaw is moved toward its latched position during closing movement of the closure on which the rotary latch is mounted; and, c) the rotary jaw and the rotary pawl are configured i) to permit the rotary pawl to effect a preliminary form of latching engagement with the rotary jaw that partially restricts the range of angular movement through which the rotary jaw can rotate in moving away from its fully latched position, and ii) to permit the rotary pawl to effect a fully latched form of latching engagement with the rotary jaw wherein the rotary jaw is retained in a fully latched position and is permitted to execute substantially no angular movement while being retained in the fully latched position.

6. The latch of claim 1 wherein said designated part of the operating arm moves from a primary position to a secondary position along a path of movement in response to movement of the projection means from the first position to the second position, and wherein the latch additionally includes key-operated lock means that is connected to the first housing means and that includes locking formation means for being moved between locked and unlocked positions in response to operation of the lock means by a suitably configured key, with the locking formation means being configured, when in its locked position, to extend into said path of movement to block said movement along said path when the locking formation means is so extended, and with the locking formation means being configured to not impede said movement along said path when the locking formation means is in its unlocked position.

7. The latch of claim 6 wherein the rear assembly means additionally includes biasing means connected to the operating arm for biasing said designated part of the operating arm away from said secondary position and toward said primary position.

8. The latch of claim 6 wherein the mounting bracket means has a lock-body-receiving opening formed therethrough, the key-operated lock means has a body that extends through the lock-body-receiving opening in close proximity thereto to restrict relative movement of the body of the lock means relative to the mounting bracket means, whereby the mounting bracket means serves to reinforce and rigidify the connection of the key-operated lock means to the latch.

9. The latch of claim 6 wherein the mounting bracket means defines a mounting post that extends rearwardly from a back wall of the mounting bracket; a central part of the operating arm is pivotally connected to the mounting post at a location spaced rearwardly from the back wall of the mounting bracket; the operating arm has a formation that extends forwardly from the central part toward the back wall of the mounting bracket, with the forwardly extending formation of the operating arm defining said designated part of the operating arm; said rearwardly projecting part of said projection means engages one side of the forwardly extending formation of the operating arm; and said locking formation means is extensible into and out of engagement with an opposite side of the forwardly extending formation to block movement of said designated part of the operating arm along said path of movement.

10. The latch of claim 9 additionally including torsion coil spring spring means connected to the operating arm and having coils that extend about a portion of the mounting post for biasing said designated part of the operating arm away from said secondary position and toward said primary position.

11. The latch of claim 6 wherein the designated part of the operating arm has a generally U-shaped portion that is defined by first and second opposed, spaced, rearwardly extending legs that each connect at one end with a one of two opposite ends of a third leg that extends closely alongside said rear wall of the mounting bracket means, with the first of the opposed legs being configured and positioned to be engaged by said rearwardly projecting part of said projecting means, and with the second of the opposed legs being configured and positioned to be engaged by said locking formation means when said locking formation means is in said locked position.

12. The latch of claim 1 additionally including lockable means for selectively blocking movement of said designated part of the operating arm in such a way that, and wherein the projection means is configured to cooperate with the lockable means and with the handle such that, when movement of the operating arm is blocked, movement of the handle out of its non-operated position also is blocked.

13. The latch of claim 1 wherein the mounting bracket means is defined, at least in part, by a stamped metal plate that has a first substantially flat portion that defines said rear wall and extends substantially parallel to the back wall of the pan-shaped housing when the rotary latch is mounted on the closure, and that has a second substantially flat portion that extends substantially perpendicular to said first portion, with the second portion serving to define one of the first and second housing side plates.

14. The latch of claim 1 wherein the fastener means includes first threaded fastener means 1) for being non-releasably connected to a selected one of the front assembly means and the rear assembly means, 2) for being releasably connected to the other of the front assembly means and the rear assembly means, and 3) for being tightened in place when connected to said other of the front and rear assembly means to clamp the front and rear assembly means toward each other.

15. The latch of claim 1 wherein the mounting bracket means is a one-piece member that defines a chosen one of the first and second housing side plates, and orients the chosen side plate to extend substantially perpendicular to said rear wall.

16. The latch of claim 15 wherein the operating arm is pivotally connected to the mounting bracket means for movement about an axis that extends substantially perpendicular to said first and second transverse axes.

17. The latch of claim 1 wherein the mounting flange of the pan-shaped housing is substantially flat, and the latch additionally includes outer gasket means having a curved surface and a non-uniform thickness for filling a space between and for providing a weather-tight seal between the flat mounting flange and a front surface of the closure that is curved so as to not extend parallel to the flat mounting flange.

18. The latch of claim 17 additionally including inner gasket means having an oppositely curved surface for assisting the outer gasket means to provide a weather-tight seal between the latch and the closure.

19. The latch of claim 1 wherein at least one of the first and second spacers has at least one selected end region that extends into a separate, hex-shaped opening formed through a selected one of the first and second housing side plates and is expanded to fit tightly within said hex-shaped opening to form a secure, rotation resistant connection between the selected spacer end region and the selected housing side plate.

20. The latch of claim 1 wherein each of the first and second spacers has its opposite end regions extending into separate, hex-shaped openings formed through the first and second housing side plates and expanded in place in said hex-shaped openings to provide secure, tight fitting connections between the first and second spacers and the first and second housing side plates that resist rotation of the first and second spacers about said first and second transverse axes relative to the first and second housing side plates.

21. The latch of claim 1 additionally including biasing means for biasing the operating handle toward its non-operated position.

22. The latch of claim 21 wherein said biasing means includes spring means interposed between the operating handle and the pan-shaped housing.

23. The latch of claim 21 wherein said biasing means includes spring means connected to the operating arm and an element of the rear assembly means, and operable through the engagement of the operating arm with the projection means, and through the connection of the projection means with the operating handle to bias the operating handle toward its non-operated position.

24. The latch of claim 1 additionally including gasket means extending about said projection means at a location near said main back wall opening for sealing said main back wall opening against penetration therethrough of foreign matter.

25. The latch of claim 24 wherein said gasket means includes a gasket that is carried by said handle means for being movable therewith relative to the pan-shaped housing.

26. A flush-mountable, handle-operable rotary lock for mounting on a closure for releasably retaining the closure in a closed position by latchingly engaging a suitably configured strike formation that is located within relatively close proximity to the rotary lock when the closure is in its closed position, comprising:

a) flush-mountable front assembly means for mounting as a first modular assembly on a closure adjacent a mounting opening that is formed through a front wall of the closure, including:

i) first housing means including a one-piece pan-shaped housing for being mounted on a closure adjacent the mounting opening, with the housing having a combination of back and side walls that cooperate to define a substantially rectangular, forwardly-facing recess, and with the housing having a substantially flat mounting flange that extends principally in an imaginary front plane 1) to perimetrically surround the forwardly-facing recess, 2) to closely overlie portions of a front surface of the closure's front wall that extend perimetrically about the mounting opening, and 3) to be clamped toward engagement with said portions of the closure's front surface to substantially flush-mount the pan-shaped housing on the closure;

ii) with the back and side walls being configured such that the forwardly-facing recess has 1) a generally rectangular shape, 2) having a main back wall portion that is substantially flat and extends in an imaginary main back wall plane that substantially parallels the imaginary front plane, and 3) having a minor back wall portion that is substantially flat and extends in an imaginary minor back wall plane that substantially parallels the imaginary front plane and the imaginary main back wall plane at a location spaced between the imaginary back wall plane and the imaginary front plane;

iii) a main back wall opening formed through the main back wall portion, and a minor back wall opening formed through the minor back wall portion;

iv) handle means including an operating handle that is at least partially nested within the recess, and that is connected to the first housing means for movement relative to the pan-shaped housing between a non-operated position and an operated position; and, v) projection means connected to the handle and extending rearwardly through the main back wall opening for being moved by movement of the handle such that, 1) when the handle is in the non-operated position, the projection means is caused by its connection to the handle to be in a first position, 2) when the handle is moved from the non-operated position to the operated position, the projection means is caused by such movement to move from the first position to a second position, and 3) when the handle is moved from the operated position to the non-operated position, the projection means is caused by such movement to move from the second position to the first position;

b) rear assembly means for mounting as a second modular assembly on the closure, for being connected to the front assembly means to clampingly draw the mounting flange toward engagement with said portions of the closure's front surface to securely mount the rotary latch on the closure, including:

i) mounting bracket means including a mounting bracket for overlying at least a portion of the main back wall portion and at least a portion of the minor back wall portion, for bridging at least a portion of the closure's mounting opening at a location behind the back surface of the closure's front wall, for being fastener-connected to the front assembly means, and for defining back-surface engaging means for being clamped toward engagement with the back surface of the closure's front wall when the mounting flange of the first housing means is being clamped toward engagement with said portions of the closure's front surface;

ii) said mounting bracket means having a projection receiving opening formed therethrough for being aligned with the main back wall opening such that said projection means extends through the projection receiving opening when said mounting bracket means is fastener-connected to the front assembly means, with said projection receiving opening having a first end and an opposed second end, and with said projection receiving opening further being configured 1) such that, when said projection means is in said first position, a rearwardly projecting part of said projection means is located near said first end, 2) such that, when said projection means is in said second position, the rearwardly projecting part of said projection means is located near said second end, and 3) such that, when said projection means is moved between said first and second positions, said rearwardly projecting part of said projection means moves along a path of movement that is defined by the projection receiving opening; and, iii) said mounting bracket means having a lock mechanism receiving opening formed therethrough for being aligned with the minor back wall opening;

c) lock means including a lock mechanism having a body and a locking formation that is movable relative to the body, with the body having 1) a front portion that is mountable within the minor back wall opening, and 2) a rear portion that is configured to extend through the lock mechanism receiving opening in a sufficiently close fit to enable such portions of the mounting bracket means as surround the lock mechanism receiving opening to assist such portions of the first housing means as surround the minor back wall opening to maintain proper positioning of the mounted lock mechanism when the mounting bracket means is fastener-connected to the front assembly means, and with the locking formation being movable relative to the body of the mounted lock mechanism between a locking position located relatively close to said projection receiving opening, and an unlocking position located relatively farther from said projection receiving opening;

d) rotary lock means having a rotary jaw and a rotary pawl that are movably connected to the rear assembly means, with the rotary jaw being rotatable through a limited range of angular movement between latched and unlatched positions but being spring-biased toward its unlatched position, with the rotary jaw being configured so as to be able to grasp and retain its grasp a suitably configured strike formation when the rotary jaw is in the latched position, with the rotary pawl being movable between jaw-retaining and jaw-releasing positions to selectively release and retain the rotary jaw in its latched position but being spring-biased to move the rotary pawl toward its jaw-retaining position as the rotary jaw moves to its latched position, and having an operating arm that is pivotally connected to the mounting bracket means and that is capable of being pivoted relative to the mounting bracket means to move the rotary pawl to release the rotary jaw from its latched position;

e) with a designated part of the operating arm extending into engagement with said rearwardly projecting part of the projection means for being moved along a predetermined path of travel from a primary position to a secondary position to release the rotary jaw from being retained in its latched position and to thereby release the grasp of the strike formation by the rotary jaw, with said movement of the operating arm from the primary position to the secondary position taking place as a result of movement of the projection means from the first position to the second position which, in turn, takes place in response to movement of the operating handle from its non-operated position toward its operated position;

f) fastener means for connecting and clamping toward each other the housing means and the mounting bracket means to thereby clamp the back-surface engaging means of the mounting bracket toward a position of engagement with the back surface of the closure's front wall, and to clamp the mounting flange of the pan-shaped housing toward a position of engagement with said portions of the closure's front surface; and, g) with the locking formation being configured such that: when the locking formation is in said locking position, the locking formation concurrently blocks 1) movement of the rearwardly projecting part of the projection means along said path of movement, and 2) movement of said designated part of the operating arm along said path of travel whereby said projection means is retained in said first position, and said designated part of the operating arm is retained in said primary position to prevent unlocking of the latch and lock; and, when the locking formation is said unlocking position, the locking formation blocks neither of said movements.

27. The lock of claim 26 wherein the rear assembly means additionally includes biasing means connected to the operating arm for biasing said designated part of the operating arm away from said secondary position and toward said primary position.

28. The lock of claim 26 wherein the mounting bracket means defines a mounting post that extends rearwardly from a back wall of the mounting bracket; a central part of the operating arm is pivotally connected to the mounting post at a location spaced rearwardly from the back wall of the mounting bracket; the operating arm has a formation that extends forwardly from the central part toward the back wall of the mounting bracket, with the forwardly extending formation of the operating arm defining said designated part of the operating arm; said rearwardly projecting part of said projection means engages one side of the forwardly extending formation of the operating arm; and said locking formation means is extensible into and out of engagement with an opposite side of the forwardly extending formation to block movement of said designated part of the operating arm along said path of movement.

29. The lock of claim 28 additionally including torsion coil spring spring means connected to the operating arm and having coils that extend about a portion of the mounting post for biasing said designated part of the operating arm away from said secondary position and toward said primary position.

30. The lock of claim 26 wherein the designated part of the operating arm has a generally U-shaped portion that is defined by first and second opposed, spaced, rearwardly extending legs that each connect at one end with a one of two opposite ends of a third leg that extends closely alongside said rear wall of the mounting bracket means, with the first of the opposed legs being configured and positioned to be engaged by said rearwardly projecting part of said projecting means, and with the second of the opposed legs being configured and positioned to be engaged by said locking formation means when said locking formation means is in said locked position.

31. The lock of claim 26 wherein the mounting bracket means is defined, at least in part, by a stamped metal plate that defines said rear wall to extend substantially parallel to the back wall of the pan-shaped housing when the rotary latch is mounted on the closure, and that has a second substantially flat portion that extends substantially perpendicular to said first portion, with the second portion serving to define one of the first and second housing side plates.

32. The lock of claim 26 wherein the fastener means includes first threaded fastener means 1) for being non-releasably connected to a selected one of the front assembly means and the rear assembly means, 2) for being releasably connected to the other of the front assembly means and the rear assembly means, and 3) for being tightened in place when connected to said other of the front and rear assembly means to clamp the front and rear assembly means toward each other.

33. The lock of claim 26 wherein the mounting bracket means is a one-piece member that defines a chosen one of the first and second housing side plates, and orients the chosen side plate to extend substantially perpendicular to said rear wall.

34. The lock of claim 33 wherein the operating arm is pivotally connected to the mounting bracket means for movement about an axis that extends substantially perpendicular to said first and second transverse axes.

35. The lock of claim 26 wherein the lock additionally includes outer gasket means having a curved surface and a non-uniform thickness for filling a space between and for providing a weather-tight seal between the flat mounting flange of the pan-shaped housing and a front surface of the closure that is curved so as to not extend parallel to the flat mounting flange.

36. The lock of claim 35 additionally including inner gasket means having an oppositely curved surface for assisting the outer gasket means to provide a weather-tight seal between the latch and the closure.

37. The lock of claim 26 additionally including biasing means for biasing the operating handle toward its non-operated position.

38. The lock of claim 37 wherein said biasing means includes spring means interposed between the operating handle and the pan-shaped housing.

39. The lock of claim 37 wherein said biasing means includes spring means connected to the operating arm and an element of the rear assembly means, and operable through the engagement of the operating arm with the projection means, and through the connection of the projection means with the operating handle to bias the operating handle toward its non-operated position.

40. The lock of claim 26 additionally including gasket means extending about said projection means at a location near said main back wall opening for sealing said main back wall opening against penetration therethrough of foreign matter.

* * * * *